United States Patent [19]

Donomoto et al.

[11] Patent Number: 4,708,847

[45] Date of Patent: Nov. 24, 1987

[54] METHOD FOR ALLOYING SUBSTANCES

[75] Inventors: Tadashi Donomoto; Yoshiaki Tatematsu; Atsuo Tanaka; Masahiro Kubo, all of Toyota, Japan

[73] Assignee: Toyota Jidosha Kabushiki Kaisha, Toyota, Japan

[21] Appl. No.: 820,886

[22] Filed: Jan. 17, 1986

Related U.S. Application Data

[63] Continuation of Ser. No. 552,837, Nov. 17, 1983, abandoned.

[30] Foreign Application Priority Data

Jul. 28, 1983 [JP] Japan ..... 58-138180

[51] Int. Cl.[4] ..... C22C 1/03; C22C 33/04

[52] U.S. Cl. ..... 420/129; 420/590

[58] Field of Search ..... 420/590, 501, 528, 554, 420/563, 578, 490, 521, 435, 531, 550, 478, 441, 402, 513, 470, 560, 427, 428, 425, 824, 429, 557, 507, 524, 422, 430, 434; 75/129, 10 R, 552, 418

[56] References Cited

U.S. PATENT DOCUMENTS

| | | | |
|---|---|---|---|
| 2,612,443 | 9/1952 | Goetzel et al. | 75/22 |
| 3,125,441 | 3/1964 | Lafferty et al. | 75/10 R |
| 3,194,656 | 7/1965 | Vordahl | 420/590 |
| 3,827,883 | 8/1974 | Neely | 420/431 |
| 4,452,865 | 6/1984 | Yamatsuta et al. | 428/614 |

FOREIGN PATENT DOCUMENTS

| | | | |
|---|---|---|---|
| 45510 | 2/1982 | European Pat. Off. . | |
| 152141 | 11/1980 | Japan . | |
| 89373 | 7/1981 | Japan | 75/10 R |
| 45002 | 2/1982 | Japan | 420/590 |
| 564905 | 10/1944 | United Kingdom . | |

*Primary Examiner*—Christopher W. Brody
*Attorney, Agent, or Firm*—Oblon, Fisher, Spivak, McClelland, & Maier

[57] ABSTRACT

An alloy is made of a first material and a second material which has a substantially lower melting point than the first material, by (a) forming from the first material a body which has multiple fine interstices; (b) pouring the second material in the molten state around the body formed from the first material; and (c) allowing the resultant mass to cool. Thus, in the parts of the resultant mass in which the body formed from the first material was originally present, an alloy mass comprising the first metal and the second material alloyed together is made. Optionally, the body made from the first material may be preheated, desirably to a temperature higher than the melting point of the second material; and optionally the molten second material may be pressurized so as to enter into the interstices of the body. The first material may desirably be, for example, tungsten, cobalt, chromium, titanium, iron, nickel, silicon, manganese, copper, niobium, tantalum, vanadium, gold, silver, aluminum, molybdenum, zirconium, or zinc; and the second material may desirably be, for example, aluminum, magnesium, copper, lead, tin, or zinc.

33 Claims, 24 Drawing Figures

METHOD FOR ALLOYING SUBSTANCES

This application is a continuation of application Ser. No. 552,837, filed Nov. 17, 1983, now abandoned.

BACKGROUND OF THE INVENTION

The present invention relates to a method of producing an alloy, and to an apparatus for practicing said method; and more particularly relates to a method of producing an alloy of two materials such as metals or mixtures thereof which have substantially different melting points, and to an apparatus for practicing such a method.

It should be understood that, although henceforward in the present specification the present invention will be described in terms of manufacturing an alloy of two metals, and the terms "the first metal" and "the second metal" will be utilized hereinafter freely, this is not intended to restrict the scope of the present invention to less than that of the claims appended to this specification: in particular, the two materials an alloyed mixture of which is formed according to the method of the present invention by the apparatus of the present invention can be elemental metals as a particular case and some of the particular exemplary embodiments which will be described later relate to such cases, but this is not an essential feature of the present invention, and notwithstanding the language utilized hereinafter for purposes of conciseness of description each of these constituents may in fact alternatively be a metal-like element, an alloy of metals, or an alloy of metals and/or metal-like elements. All such variations are to be understood as coming within the scope of the present invention.

In the prior art, then, for making an alloy of a first and a second metal, the following methods have been practiced.

First, and most simply, both the first and the second metal have been melted, and then the molten first and second metals have been mixed together and stirred together so as to be intimately compounded, the resultant mixture then being cooled and solidified. Secondly, as an alternative, the first metal has been melted, and the second metal has been added thereto in powder form or the like and stirred thereinto. These methods suffer from the disadvantages that, if both the first and the second metal must be melted, a large amount of heat energy is required, and also that if the specific gravity difference between the first and the second metal is large it is very difficult to secure good and uniform mixing of the first and second metals in order to obtain an alloy which has a uniform composition. Further, many metals in the molten state are subject to severe attack by and combination with the gases in the atmosphere, and if either of the first and the second metal includes such a metal or metals then modification of the working atmosphere, such as establishment of a vacuum, is required. This can entail high cost.

Further, in production of an alloy in which at least one of the component metals has a high melting point, it has been practiced to make the component metals into powder, to mix these metallic powders, and then by such a process as sintering at high temperature to diffuse these component elements into one another to form an alloy. However, this method of producing an alloy is also not entirely satisfactory, for the following reasons. First, it is difficult to completely eliminate air or other gas which is initially present between the particles of the combination powder, and accordingly it is difficult to prevent some of this gas from remaining within the alloy after the sintering and diffusion process. This can lead to voids within the produced alloy, which is not of 100% density, which can severely deteriorate the strength and other mechanical properties thereof. Second, since these sintering and diffusion processes involve heating at high temperature and modification of atmosphere, again the production cost can be rather high.

SUMMARY OF THE INVENTION

Accordingly, it is the primary object of the present invention to provide a method for producing an alloy, which is better than the above described prior art methods.

It is a further object of the present invention to provide such a method of producing an alloy, which does not require a large amount of heat energy.

It is a further object of the present invention to provide such a method of producing an alloy of two metals, which only requires that that one of the metals to be alloyed should be melted which has the lower melting point.

It is a further object of the present invention to provide such a method of producing an alloy, which is suitable for alloying two metals which have a large specific gravity difference between them.

It is a further object of the present invention to provide such a method of producing an alloy, which secures good and uniform mixing of the metals therein and produces an alloy which has a uniform composition.

It is a further object of the present invention to provide such a method of producing an alloy, which is suitable for application to metals at least one of which is subject to combination with gases in the atmosphere, without requiring modification of the working atmosphere such as establishment of a vacuum.

It is a further object of the present invention to provide such a method of producing an alloy, which can be practiced as conveniently and efficiently as possible.

It is a further object of the present invention to provide such a method of producing an alloy, which can be practiced at as low a cost as possible.

It is a further object of the present invention to provide such a method of producing an alloy, which can completely eliminate air or other gas from the produced alloy.

It is a further object of the present invention to provide such a method of producing an alloy, which substantially eliminates the possibility of voids occurring within the alloy.

It is a further object of the present invention to provide such a method of producing an alloy, which can ensure high and consistent strength and other mechanical properties of the produced alloy.

It is a further object of the present invention to provide such a method of producing an alloy, which can ensure desired non-isotropic properties of the produced alloy.

It is a yet further object of the present invention to provide an apparatus for producing an alloy, the operation of which can achieve one or more of the various above objects.

According to the most general method aspect of the present invention, these and other objects relating to a method are accomplished by a method for making an alloy of a first material and a second material which has a substantially lower melting point than said first material, comprising the steps, in the specified order, of: (a) forming from said first material a body which has multiple fine interstices; (b) pouring said second material in the molten state around said body formed from said first material; and (c) allowing the resultant mass to cool; (d) whereby, in the parts of said resultant mass in which said body formed from said first material was originally present, an alloy mass comprising said first metal and said second material alloyed together is made.

According to such a method, the requirement for use of heat energy is minimized, as compared with prior art methods in which both of the materials to be alloyed are required to be melted, since in the present invention as specified above only the second material which has the lower melting point is required to be melted, while the first material is allowed to remain in the solid phase. This is very important from the point of view of energy saving and consequent reduction of the cost of practicing the alloying process. Further, because the penetration process of the molten second material into the interstices of the body formed of the first material is quite indifferent to differences between the specific gravities of the first and the second material, this process is well suited to forming an alloy of two materials which have widely differing specific gravities. The method of the present invention, as will become apparent from the description and results of the preferred embodiments given hereinafter, can secure good and uniform mixing of the first and second materials, and can produce an alloy which has a acceptably uniform composition. Even if when melted the first material would be subject to combination with gases in the atmosphere such as oxidization, since said first material is not required to be melted, thus no risk of such combination occurs, and the method according to the present invention is thus suitable for making an alloy of such a first material, and does not require modification of the working atmosphere such as establishment of a vacuum. Further, by the action of the penetration of the molten second material into the interstices of the body made of the first material, air or other gases in such interstices is driven out to the outside, and accordingly it is possible to produce an alloy of a higher density and with less voids therein by the present invention, than by the prior art type sintering method described hereinabove.

Further, according to a more particular method aspect of the present invention, these and other objects relating to a method are more particularly and concretely accomplished by a method for making an alloy as described above, wherein, between step (a) and step (b), additionally: (e) said body formed from said first material is preheated to a temperature higher than ambient temperature.

According to such a method, the preheating of the interstice ridden body made of the first material is very helpful in helping with the penetration of the molten second material thereinto, since the molten second material is thereby less quickly solidified during this penetration than would otherwise be the case, and since also the wettability together of the first material and the second material is thereby improved. Further, in the event that in step (e) said temperature higher than ambient to which said body formed from said first material is preheated is a temperature higher than the melting point of said second material, then said penetration of the molten second material into the interstice ridden body made of the first material is aided even more, since effectively there is produced no immediate tendency at all for the molten second material to solidify as it is being penetrated into the interstices of the body made of the first material, and since the wettability together of the first and the second material is thereby even more improved.

Further, according to a yet more particular method aspect of the present invention, these and other objects relating to a method are more particularly and concretely accomplished by a method for making an alloy in any one of the manners outlined above, wherein during step (c) said resultant mass formed from said first material with said molten second material around it is pressurized.

According to such a method, the above described action of penetration of the molten second material into the interstices of the body made of the first material is even more improved, and accordingly the air or other gases in such interstices is even more effectively driven out. Accordingly it is possible to produce an alloy of virtually 100% density, with virtually no voids.

Now, the interstice ridden body made of the first material may be made by compacting powder of said first material; and in this case the average particle size is desirably less than about 100 microns, and even more desirably is less than about 50 microns, in view of the desirability of making a resultant alloy with a smooth and fine and uniform composition. On the other hand, said interstice ridden body made of the first material may alternatively be formed by compacting a mass of discontinuous fibers of said first material, or a mass of fine rods thereof, or a mass of chips, or a sheaf of fibers, or particularly by laminating together multiple layers of said first material. In the cases of using a sheaf of fibers of said first material, or a mass of rods bundled together, or laminating together multiple layers or foils of said first material, then a desired non isotropic quality may be provided for some or the other property of the resultant alloy material, which is a very useful specialization of the present invention.

With regard to the selection of materials, the first material may desirably be, for example, tungsten (W), cobalt (Co), chromium (Cr), titanium (Ti), iron (Fe), nickel (Ni), silicon (Si), manganese (Mn), copper (Cu), niobium (Nb), tantalum (Ta), vanadium (V), gold (Au), silver (Ag), aluminum (Al), molybdenum (Mo), zirconium (Zr), or zinc (Zn); and the second material may desirably be, for example, aluminum (Al), magnesium (Mg), copper (Cu), lead (Pb), tin (Sn), or zinc (Zn). Alternatively, the first and/or the second material may be an alloy containing one or more of these various elements.

An important application of the method of producing an alloy according to the present invention is as follows. If some of the outer parts of the composite mass solidified in the casting mold which were composed of substantially pure second material are not machined off in their entirety, but are left as attached to the part of the solidified composite mass which is made of alloy of the first and the second material, then a resultant object is manufactured which has one or more of its parts made of alloy of the first and the second material and its remainder parts made substantially only of the second material. This may be very convenient for some particular application. Further, if the casting mold is made in a particular shape so as to yield a desired cast object, i.e. a finished product, it is possible as explained above to make said finished product with a particular part or parts thereof only manufactured of alloy of the first and the second material, the remainder thereof being made of the second material only. This is not possible in the prior art, and is an important specialization of the present invention.

Further, the concept of the present invention encompasses apparatus for performing the methods described above. Several different apparatuses have been conceived of, the applicability of each of which will depend upon various circumstances. In detail, a first such apparatus can comprise a casting mold for receiving therein a body formed from said first material which has multiple fine interstices, and a plunger for pressurizing a molten mass of said second material around said body in said casting mold. A second such apparatus can comprise a movable die for receiving therein a body formed from said first material which has multiple fine interstices, and a fixed die, arranged to cooperate selectively with said movable die according to the movement of said movable die, including a means for pressurizing a molten mass of said second material so as to inject said molten mass into said movable die around said body in said movable die. A third such apparatus can comprise a spinnable mold chamber for receiving therein a body formed from said first material which has multiple fine interstices, and a means for supplying a molten mass of said second material into said spinnable mold chamber around said body in said spinnable mold chamber. A fourth such apparatus can comprise a vacuum chamber for receiving therein a body formed from said first material which has multiple fine interstices, and a means for sucking into said vacuum chamber a molten mass of said second material around said body in said vacuum chamber. And a fifth such apparatus can comprise a chamber for receiving therein a body formed from said first material which has multiple fine interstices, and a means for moving by blowing by gas pressure into said chamber a molten mass of said second material around said body in said chamber.

BRIEF DESCRIPTION OF THE DRAWINGS

The present invention will now be shown and described with reference to several preferred embodiments thereof, and with reference to the illustrative drawings. It should be clearly understood, however, that the description of the embodiments, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings, like parts and features are denoted by like reference symbols in the various figures thereof, and:

DESCRIPTION OF THE PREFERRED EMBODIMENTS

The present invention will now be described with reference to several preferred embodiments thereof, and with reference to the appended drawings.

THE FIRST PREFERRED EMBODIMENT

Figure 1:
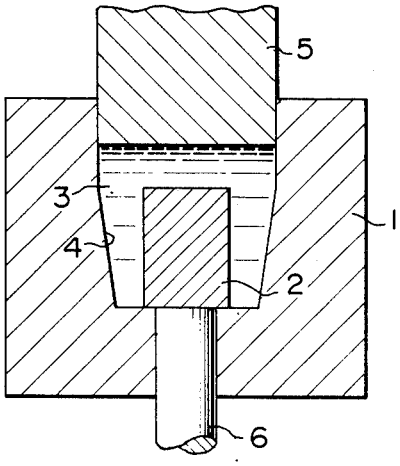
FIG. 1 is a longitudinal partial cross sectional view of a high pressure casting apparatus which is a first preferred embodiment of the apparatus of the present invention, and is used for practicing the first preferred embodiment of the method of the present invention, as well as other preferred embodiments.

FIG. 1 is a longitudinal cross sectional view of a high pressure casting apparatus according to the first preferred embodiment of the apparatus of the present invention, used for practicing the first preferred embodiment of the method of the present invention. In this figure, the reference numeral 1 denotes a casting mold, which is formed with a mold cavity 4 for receiving a body of porous material 2, which has many fine interstices, and is made of the first metal to be alloyed. A molten mass 3 of the second metal to be alloyed is poured into said mold cavity 4 around said porous material body 2, and the upper side of this molten second metal mass 3 is pressurized by a plunger 5, which closely fits into and slides in the upper part of the mold cavity 4. There is also provided a knock out pin 6 which slides in and closely cooperates with a hole in the bottom of the casting mold 1.

Using this apparatus, an alloy of a first metal which was titanium (Ti, melting point 1668° C.+/−10° C.) and a second metal which was aluminum (Al, melting point approximately 660° C.) was manufactured as follows. First, 6.94 grams of pure Ti powder, which had a mean particle size of approximately 40 microns, was compression molded to form a porous titanium cylinder 2 (as seen in FIG. 1), of approximately 14 mm in diameter and approximately 20 mm in length, which had a bulk density of approximately 2.25 gm/cm$^3$. This titanium cylinder 2 was preheated to a temperature of approximately 600° C., and was then placed into the cavity 4 of the casting mold 1, which was preheated to a temperature of approximately 300° C. Then a mass approximately 450 cm$^3$ of Al (which had purity of approximately 99.7%) was heated to approximately 780° C. and melted, and was then poured into the mold cavity 4 around and over the titanium cylinder 2. Then, as shown in FIG. 1, the plunger 5 was slid into the upper part of the casting mold 1, and was pressed thereinto so as to pressurize the molten aluminum metal mass 3 to a pressure of approximately 1000 kg/cm$^2$. This pressure was maintained while the molten aluminum mass 3 and the titanium cylinder 2 cooled, until the composite mass had completely solidified. During this process, the molten aluminum penetrated into the many fine interstices of the porous titanium cylinder under the influence of this pressure, which was considered to substantially aid in this penetration, and the titanium of the cylinder and the molten aluminum diffused into one another to form a Ti-Al alloy mass, of course only in the region of the composite mass in which the porous titanium cylinder 2 was originally located. It is further considered that the preheating of the porous titanium cylinder 2 was very helpful in helping this penetration, since the molten aluminum was thereby less quickly solidified than would otherwise have been the case, and since this preheating also improves the wetting between the titanium and the molten aluminum. Finally, after the composite mass had completely solidified, it was removed from the cavity 4 of the casting mold 1 by pushing the knock out pin 6 upwards in the figure, and then the outer parts of the composite mass which were only composed of pure aluminum were machined off, so as to leave the part which was composed of Ti-Al alloy manufactured as explained above.

Figure 2:
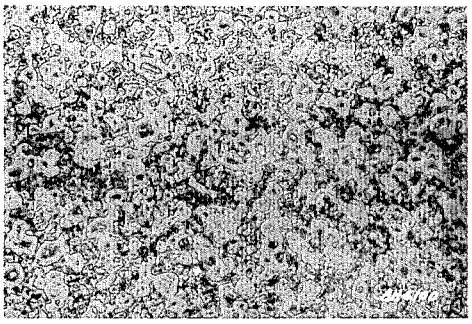
FIG. 2 is an optical microphotograph of a section of a Ti-Al alloy mass produced according to said first preferred embodiment of the method of the present invention, shown enlarged at 100X magnification.
Figure 3:
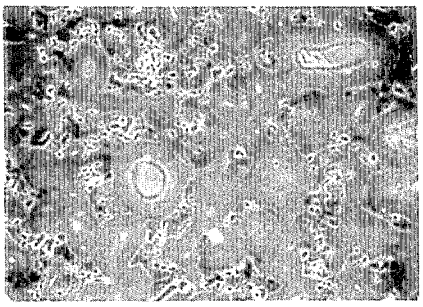
FIG. 3 is an electron micrographs of a section of said Ti-Al alloy mass, shown enlarged at 500X magnification.
Figure 4:
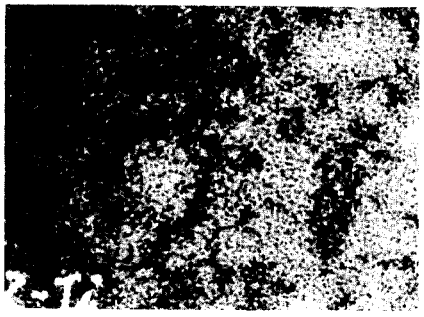
FIG. 4 is another electron micrographs of another section of said Ti-Al alloy mass, also shown enlarged at 500X magnification.
Figure 5:
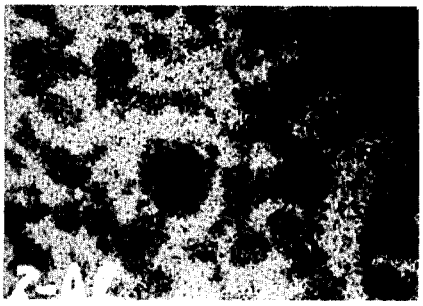
FIG. 5 is yet a third electron micrographs of a third section of said Ti-Al alloy mass, also shown enlarged at 500X magnification.

This Ti-Al alloy mass was then examined. Its macrocomposition by weight was found to be approximately 62.5% Ti and approximately 37.5% Al. FIG. 2 is an optical microphotograph of a central section thereof, enlarged at 100X magnification. From FIG. 2, it will be seen that according to this first preferred embodiment of the present invention it is possible to produce Ti-Al alloy which has uniform and relatively fine composition. Further, this Ti-Al alloy mass was analysed by EPMA. FIGS. 3 to 5 are electron micrographs of central sections of the Ti-Al mass, enlarged at 500X magnification. As can be understood from these figures, the Ti-Al alloy was composed of nuclei of substantially pure Ti, with layers of $Ti_3Al$ surrounding these nuclei, and with layers of $TiAl_3$ surrounding these layers of $Ti_3Al$. Portions consisting substantially only of pure aluminum were not to be found. Thus it was verified that the diffusion process had well and sufficiently alloyed the titanium and the aluminum to form a fine structured Ti-Al alloy mass.

When this Ti-Al alloy mass was heated in air to over 1000° C., no substantial dissolution of the metals thereof or change in the quality thereof were found, and by this it was verified that the Ti-Al alloy produced according to this first preferred embodiment of the method of the present invention had very good heat resistance.

It should be noted that an important application of the method of producing an alloy according to the present invention is as follows. Although in the above shown and described first preferred embodiment the outer parts of the composite mass solidified in the casting mold which were composed of substantially pure second metal were machined off in their entirety, so as to leave the part which was composed of alloy of the first metal and the second metal for the purposes of testing, in fact this is not essential to the practice of the present invention, and in fact if some of these parts consisting of second metal only are left then a resultant object is manufactured which has one or more of its parts made of alloy and its remainder parts made substantially only of one of the metals constituting said alloy. This may be very convenient for some particular application. Further, if the casting mold is made in particular shape so as to yield a desired cast object, i.e. a finished product, it is possible as explained above to make said finished product with a particular part or parts thereof only manufactured of alloy, the remainder thereof being made of one of the constituents only of said alloy. This is not possible with the conventional methods of alloy making described in the portion of this specification entitled "BACKGROUND OF THE INVENTION", and is an important specialization of the present invention.

THE SECOND PREFERRED EMBODIMENT

Figure 6:
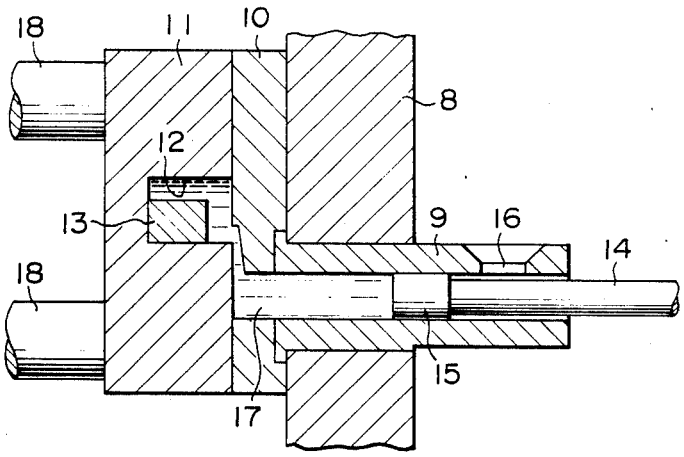
FIG. 6 is a longitudinal partial cross sectional view, similar to FIG. 1, of a cold chamber die casting machine which is a second preferred embodiment of the apparatus of the present invention, and is used for practicing the second preferred embodiment of the method of the present invention, as well as other preferred embodiments.

FIG. 6 is similar to FIG. 1, and is a longitudinal partial cross sectional view of a cold chamber die casting machine according to the second preferred embodiment of the apparatus of the present invention, used for practicing the second preferred embodiment of the method of the present invention. In this figure, the reference numeral 8 denotes a die mounting plate, to which are mounted a casting sleeve 9 and a fixed die 10. The fixed die 10 cooperates with a movable die 11, which is reciprocated in the left and right directions in the figure by a ram means or the like not specifically shown in the figure, via two members 18. The movable die 11 is formed with a mold cavity 12 for receiving a body of porous material 13 made of the first metal to be alloyed. A molten mass 17 of the second metal to be alloyed is poured through an inlet bore 16 into a cylinder bore defined inside the casting sleeve 9, and is pressurized by a plunger 15, mounted at the end of a plunger rod 14 and reciprocated by a means such as a piston and cylinder assembly or the like not shown in the drawing, which closely fits into and slides in said cylinder bore, so as to be injected into the mold cavity 12 around the porous first metal body 13. There are also provided knock out pins not shown in the figure for pushing the resulting solidified mass out of the mold cavity 12.

Using this apparatus, an alloy of a first metal which was silver (Ag, melting point approximately 960.8° C.) and a second metal which was aluminum (Al, melting point approximately 660° C.) was manufactured as follows. First, a number of about twenty thousand silver rods were lined up together and tied into a bundle by silver wires, so as to be formed into a silver cylinder 13 (as seen in FIG. 6) of total mass 16.13 grams, and of approximately 14 mm in diameter and approximately 20 mm in length, which had a bulk density of approximately 5.25 gm/cm$^3$, and which, although not strictly speaking porous, had many interstices between the rods, both longitudinally and transversely. This silver cylinder 13 was preheated to a temperature of approximately 600° C., and was then placed into the cavity 12 of the movable die 11, which was preheated to a temperature of approximately 300° C. Then a molten mass 17 of approximately 300 cm$^3$ of substantially pure Al heated to approximately 750° C. was poured through the inlet bore 16 into the cylinder bore defined inside the casting sleeve 9, and as shown in FIG. 6, the plunger 15 was slid into this cylinder bore and was pressed thereinto so as to pressurize the molten aluminum metal mass 17 to a pressure of approximately 500 kg/cm$^2$, so as to squirt this molten aluminum into the movable die cavity 12 and around and over the silver cylinder 13. This pressure was maintained while the molten aluminum mass 17 and the silver cylinder 13 cooled, until the composite mass had completely solidified. During this process, the molten aluminum penetrated into the interstices of the silver cylinder 13 under the influence of this pressure, which was considered to substantially aid in this penetration, and the silver of the rods of the cylinder 13 and the molten aluminum diffused into one another to form a Ag-Al alloy mass, of course only in the region of the composite mass in which the porous silver cylinder 13 was originally located. It is further considered that the preheating of the silver cylinder 13 was very helpful in helping this penetration, since the molten aluminum was thereby less quickly solidified than would otherwise have been the case. Finally, after the composite mass had completely solidified, the movable die 11 was removed from the fixed die 10, and the composite mass was removed from the cavity 12 of said movable die 11 by pushing the knock out pins (not shown), and then the outer parts of the composite mass which were only composed of pure aluminum were machined off, so as to leave the part which was composed of Ag-Al alloy manufactured as explained above.

Figure 7:
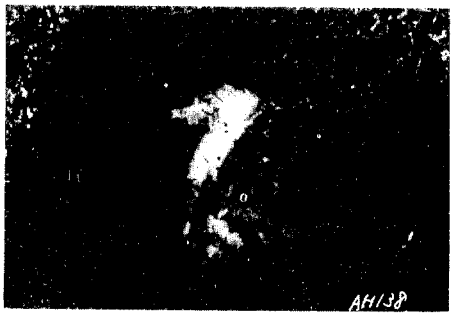
FIG. 7 is an optical microphotographs, similar to FIG. 2, of a section of an Ag-Al alloy mass produced according to said second preferred embodiment of the method of the present invention, shown enlarged at 100X magnification.

This Ag-Al alloy mass was then examined. Its macrocomposition by weight was found to be approximately 79.5% Ag and approximately 20.5% Al. FIG. 7, which is similar to FIG. 2, is an optical microphotograph of a central section thereof, enlarged at 100X magnification. From FIG. 7, it will be seen that according to this second preferred embodiment of the present invention it is possible to produce Ag-Al alloy which has uniform and relatively fine composition. Further, this Ag-Al alloy mass was analysed by EPMA. It was found that the Ag-Al alloy was composed of linear nuclei of $Ag_2Al$ with layers of AgAl surrounding these nuclei, and with layers of $AgAl_3$ surrounding these layers of AgAl. Portions consisting substantially only of pure aluminum were not to be found. Thus it was verified that the diffusion process had well and sufficiently alloyed the silver and the aluminum to form a fine structured Ag-Al alloy mass.

When this Ag-Al alloy mass was tested in various appropriate ways, it was verified that the Ag-Al alloy produced according to this second preferred embodiment of the method of the present invention had very good electrical conductivity, heat resistance, and mechanical strength, and was a very appropriate material for manufacture of electrical contact points.

The previously noted application of the method of producing an alloy according to the present invention also applies to this second preferred embodiment: if the movable die 11 is made in a particular shape so as to yield a desired finished product, then this finished product may be made with a particular part or parts thereof only manufactured of alloy, the remainder thereof being made of one of the constituents of said alloy. This is a very important specialization of the present invention.

THE THIRD PREFERRED EMBODIMENT

Figure 8:
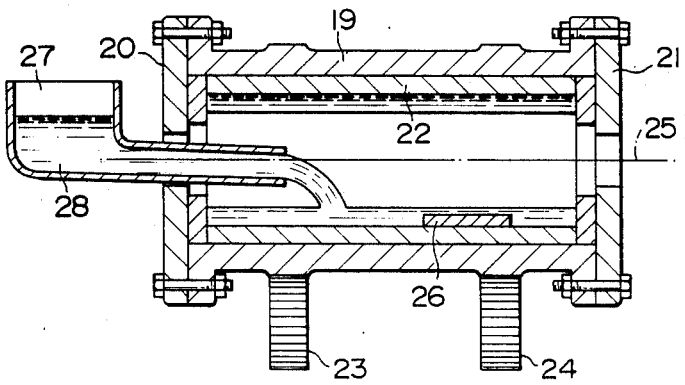
FIG. 8 is a longitudinal partial cross sectional view, similar to FIGS. 1 and 2, of a horizontal centrifugal casting apparatus which is a third preferred embodiment of the apparatus of the present invention, and is used for practicing the third preferred embodiment of the method of the present invention, as well as another preferred embodiment.

FIG. 8 is similar to FIGS. 1 and 2, and is a longitudinal partial cross sectional view of a horizontal centrifugal casting apparatus according to the third preferred embodiment of the apparatus of the present invention, used for practicing the third preferred embodiment of the method of the present invention. In this figure, the reference numeral 22 denotes a casting mold, which is formed as a hollow cylinder of inner diameter about 100 mm and is fitted removably into a hollow cylindrical mold housing 19, the two axial ends of which are respectively closed with end plates 20 and 21 which are pierced with holes in their centers. The mold housing 19 is mounted on two rollers 23 and 24 so as to be rotatable about its central axis 25, and is selectively so rotated at quite a high rotational speed by a means not shown in the figure. A body of porous material 26, which has many fine interstices, and is made of the first metal to be alloyed, is placed within the cavity of the casting mold 22, and while the mold housing 19 and the casting mold 22 are being rapidly rotated about the axis 25 a molten mass 28 of the second metal to be alloyed is poured into said mold cavity of the casting mold 22 through a tube 27 passed through the central opening in the rotating end plate 20, so as to cover said porous material body 26 by being spun against the inner cylindrical surface of said casting mold 22 by centrifugal force in a per se well known manner. At this time, because of the high speed of rotation of the casting mold 22, the pressure which forces the molten second metal mass 28 into the interstices of said porous material body 26 is very considerable.

Using this apparatus, an alloy of a first metal which was aluminum (A1, melting point approximately 660° C.) and a second metal which was lead (Pb, melting point 327.4° C.) was manufactured as follows. First, 5.4 grams of pure Al powder, which had a mean particle size of approximately 35 microns, was compression molded to form a porous rectangular parallelpiped 26 (as seen in FIG. 8), of dimensions approximately 10 mm×10 mm×40 mm, which had a bulk density of approximately 1.35 gm/cm$^3$. This aluminum parallelpiped 26 was preheated to a temperature of approximately 400° C., and was then placed into the cavity of the casting mold 22, which was preheated to a temperature of approximately 100° C. Then a molten mass of approximately 500 cm$^3$ of substantially pure Pb heated to approximately 400° C. was poured into the mold cavity while it was spinning at a speed of about 200 revolutions per minute, and was collected around and over the aluminum parallelpiped 26. 2. At this time, the molten lead metal mass 28 was pressurized to a considerable pressure around the aluminum parallelepiped 26 by the effect of centrifugal force. The spinning was maintained while the molten lead mass 28 and the aluminum parallelepiped 26 cooled, until the composite mass had completely solidified. During this process, the molten lead penetrated into the many fine interstices of the porous aluminum mass under the influence of this pressure due to centrifugal force, which is considered to have substantially aided in this penetration, and the aluminum of the parallelepiped 26 and the molten lead diffused into one another to form a Al-Pb alloy mass, of course only in the region of the composite mass in which the porous aluminum parallelepiped 26 was originally located. It is further considered that the preheating of the aluminum parallelepiped 26 was very helpful in helping this penetration, since the molten lead was thereby less quickly solidified than would otherwise have been the case; and particularly it is considered that the preheating of the aluminum parallelepiped 26 to a temperature (of approximately 400° C.) which was substantially higher than the melting point of the lead second metal (approximately 327.4° C.) was particularly helpful in this penetration, since effectively there is produced no immediate tendency at all for the molten lead to solidify as it is being penetrated into the interstices of the aluminum parallelepiped 26. Finally, after the composite mass had completely solidified, it was removed from the cavity of the casting mold 22, and then the outer parts of the composite mass which were only composed of pure lead were machined off, so as to leave a rectangular parallelepipedal part which was composed of Al-Pb alloy manufactured as explained above.

Figure 9:
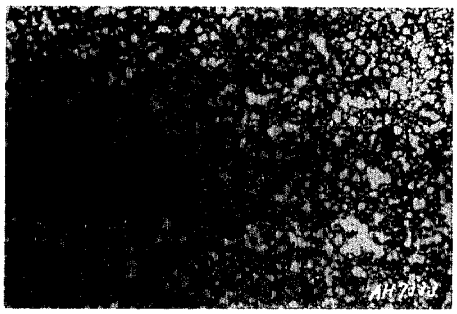
FIG. 9 is an optical microphotograph, similar to FIGS. 2 and 7, of a section of an Al-Pb alloy mass produced according to said third preferred embodiment of the method of the present invention, shown enlarged at 100X magnification.

This Al-Pb alloy mass was then examined. Its macrocomposition by weight was found to be approximately 19.2% Al and approximately 80.8% Pb. FIG. 9 is similar to FIGS. 2 and 7, and is an optical microphotograph of a central section thereof, enlarged at 100X magnification. From FIG. 9, it will be seen that according to this third preferred embodiment of the present invention it is possible to produce Al-Pb alloy which has uniform and relatively fine composition. This is difficult to do by the conventional methods outlined in the portion of this specification entitled "BACKGROUND OF THE INVENTION", because of the great difference between the specific gravity of aluminum, which is approximately 2.699, and the specific gravity of lead, which is approximately 11.36. Further, this Al-Pb alloy mass was analysed by EPMA. As a result of this, the Al-Pb alloy was found to be composed of nuclei of substantially pure Al, with layers of $Al_3Pb$ surrounding these nuclei, and with layers of $AlPb_2$ surrounding these layers of $Al_3Pb$. Portions consisting substantially only of pure lead were not to be found. Thus it was verified that the diffusion process had well and sufficiently alloyed the aluminum and the lead to form a fine structured Al-Pb alloy mass.

The Al-Pb alloy produced according to this third preferred embodiment of the method of the present invention was found to be suitable for being soldered, and also, due to the per se well known self lubricating properties of Pb, this Al-Pb alloy was found to be very suitable for use as bearing material.

THE FOURTH PREFERRED EMBODIMENT

Figure 10:
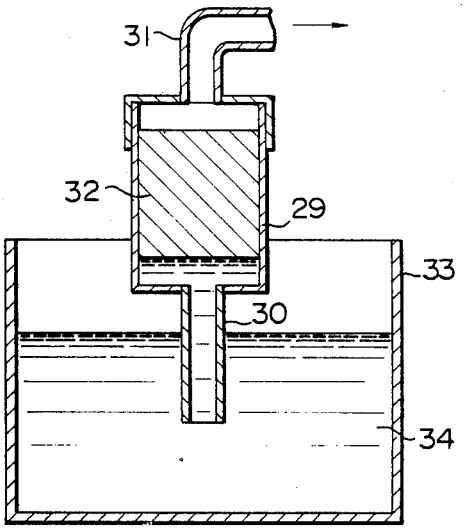
FIG. 10 is a longitudinal partial cross sectional view, similar to FIGS. 1, 2, and 8, of a vacuum casting apparatus which is a fourth preferred embodiment of the apparatus of the present invention, and is used for practicing the fourth preferred embodiment of the method of the present invention.

FIG. 10 is a longitudinal partial cross sectional view of a vacuum casting apparatus according to the fourth preferred embodiment of the apparatus of the present invention, used for practicing the fourth preferred embodiment of the method of the present invention. In this figure, the reference numeral 29 denotes a sealed alloying chamber, the upper end of which in the figure is connected to an air exhausting pipe 31 which leads to a means for providing vacuum which is not shown in the figures, and the lower end of which is communicated to a molten metal pickup pipe 30 which extends downwards. The alloying chamber 29 is formed with a mold cavity for receiving a body of porous material 32, which has many fine interstices, and is made of the first metal to be alloyed. A molten mass 34 of the second metal to be alloyed is poured into a molten metal storage tank 33 so as to surround the lower end of the molten metal pickup pipe 30 which dips thereinto, and the means for providing vacuum sucks air through the exhausting pipe 31 out of the inside of the alloying chamber 29 and through and out of the interstices of the porous body 32 made of the first metal, so as to suck up said molten second metal from the storage tank 33 to be penetrated into said interstices.

Using this apparatus, an alloy of a first metal which was silicon (Si, melting point approximately 1410° C.) and a second metal which was copper (Cu, melting point approximately 1083° C.) was manufactured as follows. First, 3.6 grams of pure Si powder, which had a mean particle size of approximately 60 microns, was compression molded to form a porous silicon cylinder 32 (as seen in FIG. 10), of approximately 14 mm in diameter and approximately 20 mm in length, which had a bulk density of approximately 1.17 gm/cm$^3$. This silicon cylinder 32 was then press fitted into the cavity of the alloying chamber 29 (which was made of stainless steel), and the whole was preheated to a temperature of approximately 800° C. Then a mass of substantially pure copper was heated in the molten metal storage tank 33 to approximately 1200° C. and melted, and then the vacuum pump (not shown) was operated, so as to lower a pressure within the alloying chamber 20 to a very low pressure of about 0.05 kg/cm$^2$, i.e. so as to substantially exhaust all the air from the pipe 31, the interior of the alloying chamber 29 and the interstices of the porous silicon cylinder 32, and the pipe 30 in a progressive manner with said air flowing in the upwards direction as seen in the figure, so as to suck up some of the molten copper in the tank 33 to surround and cover the silicon cylinder 32, and to suck said molten copper through the interstices thereof. This vacuum value was maintained until the composite mass in the chamber 29 had cooled and completely solidified. During this process, the molten copper penetrated into the many fine interstices of the porous silicon cylinder under the influence of this vacuum, which was considered to substantially aid in this penetration, and the silicon of the cylinder and the molten copper diffused into one another to form an Si-Cu alloy mass, of course only in the region of the composite mass in which the porous silicon cylinder 32 was originally located. It is further considered that the preheating of the porous silicon cylinder 32 was very helpful in helping this penetration, since the molten copper was thereby less quickly solidified than would otherwise have been the case. Finally, after the composite mass had completely solidified, it was removed from the cavity of the alloying chamber 29, and then the end and outer parts of the composite mass which were only composed of pure copper were machined off, so as to leave the part which was composed of Si-Cu alloy manufactured as explained above.

Figure 11:
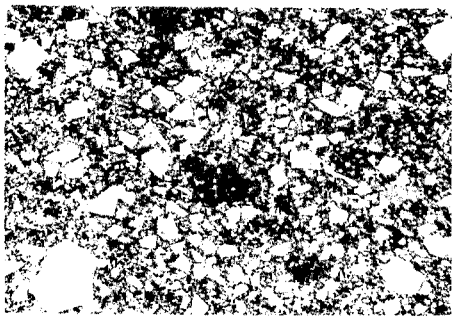
FIG. 11 is an optical microphotograph, similar to FIGS. 2, 7, and 9, of a section of an Si-Cu alloy mass produced according to said fourth preferred embodiment of the method of the present invention, enlarged at 100X magnification.

This Si-Cu alloy mass was then examined. Its macrocomposition by weight was found to be approximately 20.7% Si and approximately 79.3% Cu. FIG. 11 is an optical microphotograph of a central section thereof, enlarged at 100X magnification. From FIG. 11, it will be seen that according to this fourth preferred embodiment of the present invention it is possible to produce Si-Cu alloy which has uniform and relatively fine composition. Further, this Si-Cu alloy mass was analysed by EPMA. It was found that the Si-Cu alloy composed of nuclei of substantially pure Si, with layers of SiCu surrounding these nuclei, and with layers of $Si_2Cu_9$ surrounding these layers of SiCu. Portions consisting substantially only of pure copper were not to be found. Thus it was verified that the diffusion process had well and sufficiently alloyed the silicon and the copper to form a fine structured Si-Cu alloy mass.

When this Si-Cu alloy mass was subjected to appropriate tests, it was found that it had a good abrasion resistance and good electrical conductivity.

THE FIFTH PREFERRED EMBODIMENT

Figure 12:
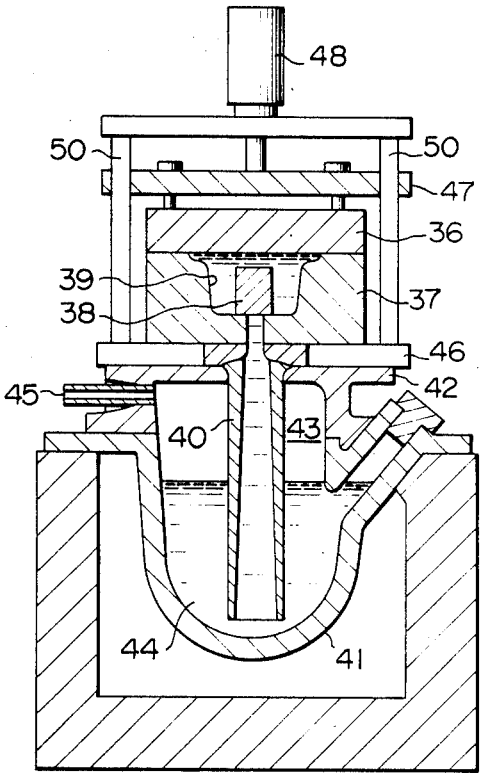
FIG. 12 is a longitudinal partial cross sectional view, similar to FIGS. 1, 2, 8, and 10, of a low pressure casting apparatus which is a fifth preferred embodiment of the apparatus of the present invention, and is used for practicing the fifth preferred embodiment of the method of the present invention.

FIG. 12 is a longitudinal partial cross sectional view of a low pressure casting apparatus according to the fifth preferred embodiment of the apparatus of the present invention, used for practicing the fifth preferred embodiment of the method of the present invention. In this figure, the reference numerals 36 and 37 respectively denote upper and lower molds, which by their cooperation define a mold cavity 39 of about one liter capacity which is sealed when the upper and lower molds 36 and 37 are pressed together; the lower mold 37 is fixed to a die base 46, and the upper mold 36 is fixed to a die plate 47 which is slidably mounted to said die base 46 by sliding on rods 50; the die plate 47 and the upper mold 36 fixed thereto are moved upwards and downwards in the drawing as required by an actuator 48 of a per se well known sort.

The lower side of the mold cavity 39 is communicated to a molten metal pickup pipe 40 which extends downwards. The mold cavity 39 is adapted to receive a body of porous material 38, which has many fine interstices, and is made of the first metal to be alloyed. A molten mass 44 of the second metal to be alloyed is poured into a closed space 43 defined within a molten metal storage crucible 41 (the top of which is closed by a lid 42) so as to surround the lower end of the molten metal pickup pipe 40 which dips thereinto, and a means for providing compressed air injects such compressed air through a supply pipe 45 to the part of the space 43 not filled with such molted metal 44, i.e. above the free surface of said molten metal 44, so as to force by its pressure some of the said molten second metal mass 44 from the storage crucible 41 upwards through the pipe 40 out of the crucible 41 into the mold cavity 39, and so as thereby to surround the porous first metal body 38 with such molten second metal and to penetrate said molten second metal into the interstices of the porous body 38 made of the first metal. Optionally, as shown in FIG. 12, said porous body 38 may be laid, in the mold cavity 39, over the upper end of the pipe 40, so that as the gas originally present in the mold cavity 39 is compressed the stream of molten second metal emerging from said upper end of said pipe 40 is positively made to flow through the interstices of said porous body 38.

Using this apparatus, an alloy of a first metal which was cobalt (Co, melting point approximately 1495° C.) and a second metal which was aluminum (Al, melting point approximately 660° C.) was manufactured as follows. First, 13.64 grams of pure Co powder, which had a mean particle size of approximately 1 micron, was compression molded to form a porous cobalt cylinder 38 (as seen in FIG. 12), of approximately 14 mm in diameter and approximately 20 mm in length, which had a bulk density of approximately 4.43 gm/cm$^3$. This cobalt cylinder 38 was preheated to a temperature of about 800° C., and was then placed into the mold cavity 39, the upper and lower molds 36 and 37 having first been preheated to a temperature of approximately 400° C. Then a mass substantially pure aluminum was heated in the molten metal storage crucible 41 to approximately 800° C. and melted, and then the compressed air supply means (not shown) was operated, so as to raise the pressure within the space 43 to a pressure of about 1.5 kg/cm$^2$. Thus, with some of said molten aluminum mass 44 flowing in the upwards direction as seen in the figure, some of it was propelled through the tube 40 upwards into the mold cavity 39 so as to surround and cover the cobalt cylinder 38, and so as to penetrate into the interstices thereof. This was facilitated by the fact, as explained above, that the cobalt cylinder 38 was laid, in the mold cavity 39, over the upper end of the pipe 40, so that as the gas originally present in the mold cavity 39 was compressed the stream of molten aluminum emerging from said upper end of said pipe 40 was positively made to flow through the interstices of said porous cobalt cylinder 38. This pressure within the space 43 was maintained while the molten aluminum and the cobalt cylinder 38 cooled, until the composite mass in the mold cavity 39 had completely solidified. During this process, the molten aluminum penetrated into the many fine interstices of the porous cobalt cylinder under the influence of this pressure, which was considered to substantially aid in this penetration, and the cobalt of the cylinder and the molten aluminum diffused into one another to form a Co-Al alloy mass, of course only in the region of the composite mass in which the porous cobalt cylinder 38 was originally located. It is further considered that the preheating of the porous cobalt cylinder 38 was very helpful in helping this penetration, since the molten aluminum was thereby less quickly solidified than would otherwise have been the case; and particularly it is considered that the preheating of the porous cobalt cylinder 38 to a temperature (of approximately 800° C.) which was substantially higher than the melting point of the aluminum second metal (approximately 660° C.) was particularly helpful in this penetration, since effectively there is produced no immediate tendency at all for the molten aluminum to solidify as it is being penetrated into the interstices of the porous cobalt cylinder 38. Finally, after the composite mass had completely solidified, it was removed from the mold cavity 39, and then the parts of the composite mass which were only composed of pure aluminum were machined off, so as to leave the part which was composed of Co-Al alloy manufactured as explained above.

Figure 13:
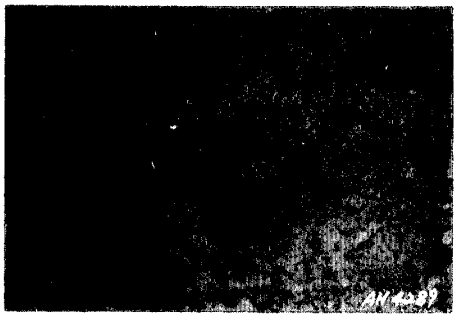
FIG. 13 is an optical microphotograph, similar to FIGS. 2, 7, 9, and 11, of a section of a Co-Al alloy mass produced according to said fifth preferred embodiment of the method of the present invention, enlarged at 100X magnification.

This Co-Al alloy mass was then examined. Its macrocomposition by weight was found to be approximately 76.6% Co and approximately 23.4% Al. FIG. 13 is an optical microphotograph of a central section thereof, enlarged at 100X magnification. From FIG. 13, it will be seen that according to this fifth preferred embodiment of the present invention it is possible to produce Co-Al alloy which has uniform and relatively fine composition. Further, this Co-Al alloy mass analysed by EPMA. It was found that the Co-Al alloy was composed of nuclei of substantially pure Co, with layers of CoAl surrounding these nuclei, and with layers of $Co_3Al_8$ surrounding these layers of CoAl. Portions consisting substantially only of pure aluminum were not to be found. Thus it was verified that the diffusion process had well and sufficiently alloyed the cobalt and the aluminum to form a fine structured Co-Al alloy mass.

When this Co-Al alloy mass was subjected to appropriate tests, it was found that it had good resistance.

The previously noted application of the method of producing an alloy according to the present invention also applies to this fifth preferred embodiment: if the mold cavity 39 is made in a particular shape so as to yield a desired product, then this finished product may be made with a particular part or parts thereof only manufactured of alloy, the remainder thereof being made of one of the constituents only of said alloy. This is a very important specialization of the present invention.

THE SIXTH PREFERRED EMBODIMENT

A high pressure casting apparatus substantially the same as that utilized in the first preferred embodiment of the method of the present invention described above and illustrated in FIG. 1 was used for practicing this sixth preferred embodiment, in which nickel (Ni, whose melting point is about 1453° C.) was chosen as the first metal to be alloyed, and magnesium (Mg, whose melting point is about 650° C.+/−2° C.) was chosen as the second metal to be alloyed. Thus, an Ni-Mg alloy was manufactured, in a generally similar fashion to that employed for the practice of the first preferred embodiment described above, in the following way.

First, a porous or interstice-ridden cylinder of substantially the same dimensions as before was made from the first metal to be alloyed, i.e. nickel, by being compression molded from about 13.7 gm of substantially pure nickel powder of mean particle size about 1.0 micron, so that the bulk density of the cylinder was approximately 4.45 gm/cm$^3$. Then this molded nickel powder cylinder was preheated to a temperature of approximately 800° C., and was then placed in the mold cavity of the casting mold, which was itself preheated to a temperature of approximately 300° C. Then a quantity of about 450 cm$^3$ of substantially pure molten magnesium at a temperature of about 750° C. was poured into the mold cavity over and around the porous nickel cylinder. Next, a pressure plunger was used, as in the practice of the first preferred embodiment, to pressurize the molten magnesium to a pressure of about 1000 kg/cm$^2$, so as to infiltrate said molten magnesium into the interstices of the nickel cylinder in order to form an Ni-Mg alloy mass by diffusion of the two metals into one another; and this pressure was maintained until the composite mass had cooled down and completely solidified. Then, as before, the composite mass was removed from the apparatus, and the portions thereof consisting substantially only of magnesium were machined away, so as to leave an Ni-Mg alloy mass.

Figure 14:
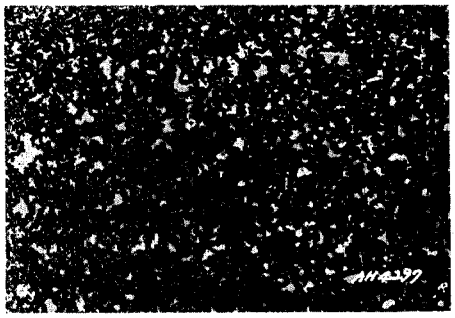
FIG. 14 is an optical microphotograph, similar to FIGS. 2, 7, 9, 11, and 13, of a section of an Ni-Mg alloy mass produced according to a sixth preferred embodiment of the method of the present invention, enlarged at 100X magnification.

This Ni-Mg alloy mass was then examined. Its macrocomposition by weight was found to be approximately 83.6% Ni and 16.4% Mg. FIG. 14 is an optical photomicrograph of a central section thereof, enlarged at 100X magnification. From FIG. 14, it will be seen that according to this sixth preferred embodiment of the present invention it is possible to produce Ni-Mg alloy which has uniform and relatively fine composition. Further, this Ni-Mg alloy mass was examined by EPMA. From this examination, it was found that the alloy was composed of nuclei of substantially pure Ni, layers of NiMg surrounding these nuclei, and other layers of $NiMg_2$ surrounding these layers of NiMg; and portions consisting substantially only of Mg were not to be found. Thus it was verified that the diffusion process had well and sufficiently alloyed the nickel and the magnesium to form a fine structured Ni-Mg alloy mass. The preheating of the porous nickel cylinder to a temperature substantially higher than the melting point of the magnesium to be alloyed therewith is considered to have been particularly helpful in aiding with the diffusion of the molten magnesium and the nickel into one another to form a well mixed alloy, in a fashion similar to that explained with reference to certain earlier embodiments.

When this Ni-Mg alloy mass was appropriately tested, it was found to have a very high capacity for damping.

THE SEVENTH PREFERRED EMBODIMENT

A high pressure casting apparatus substantially the same as that utilized in the first preferred embodiment of the method of the present invention described above and illustrated in FIG. 1 was used for practicing this seventh preferred embodiment, in which copper (Cu, whose melting point is about 1083° C.) was chosen as the first metal to be alloyed, and tin (Sn, whose melting point is about 231.9° C.) was chosen as the second metal to be alloyed. Thus, a Cu-Sn alloy was manufactured, in a generally similar fashion to that employed for the practice of the first preferred embodiment described above, in the following way.

First, a porous or interstice-ridden cylinder of substantially the same dimensions as before was made from the first metal to be alloyed, i.e. copper, by being compression molded from about 13.8 gm of substantially pure copper powder of mean particle size about 60 microns, so that the bulk density of the cylinder was approximately 4.48 gm/cm$^3$. Then this molded copper powder cylinder was preheated to a temperature of approximately 600° C., and was then placed in the mold cavity of the casting mold, which was itself preheated to a temperature of approximately 100° C. Then a quantity of about 200 cm$^3$ of substantially pure molten tin at a temperature of about 350° C. was poured into the mold cavity over and around the porous copper cylinder. Next, a pressure pluger was used, as in the practice of the first preferred embodiment, to pressurize the molten tin to a pressure of about 1000 kg/cm$^2$, so as to infiltrate said molten tin into the interstices of the copper cylinder in order to form a Cu-Sn alloy mass by diffusion of the two metals into one another; and this pressure was maintained until the composite mass had cooled down and completely solidified. Then, as before, the composite mass was removed from the apparatus, and the portions thereof consisting substantially only of tin were machined away, so as to leave a Cu-Sn alloy mass.

Figure 15:
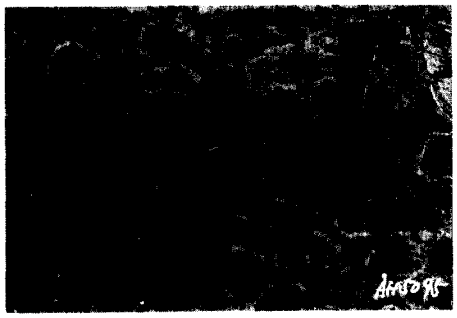
FIG. 15 is an optical microphotograph, similar to FIGS. 2, 7, 9, 11, 13, and 14, of a section of a Cu-Sn alloy mass produced according to a seventh preferred embodiment of the method of the present invention, enlarged at 100X magnification.

This Cu-Sn alloy mass was then examined. Its macrocomposition by weight was found to be approximately 55.1% Cu and 44.9% Sn. FIG. 15 is an optical photomicrograph of a central section thereof, enlarged at 100X magnification. From FIG. 15, it will be seen that according to this seventh preferred embodiment of the present invention it is possible to produce Cu-Sn alloy which has uniform and relatively fine composition. Further, this Cu-Sn alloy mass was examined by EPMA. From this examination, it was found that the alloy was composed of nuclei of substantially pure Cu, layers of $Cu_7Sn_2$ surrounding these nuclei, and other layers of $Cu_2Sn_3$ surrounding these layers of $Cu_7Sn_2$; and portions consisting substantially only of Sn were not to be found. Thus it was verified that the diffusion process had well sufficiently alloyed the copper and the tin to form a fined structured Cu-Sn alloy mass. The preheating of the porous copper cylinder to a temperature substantially higher than the melting point of the thin to be alloyed therewith is considered to have been particularly helpful in aiding with the diffusion of the molten tin and the copper into one another to form a well mixed alloy, in a fashion similar to that explained with reference to certain earlier embodiments.

When this Cu-Sn alloy mass was appropriately tested, it was found to have good abrasion resistance and strength, and accordingly it was considered that this Cu-Sn alloy was very suitable for the manufacture of bearings.

THE EIGHTH PREFERRED EMBODIMENT

A high pressure casting apparatus substantially the same as that utilized in the first preferred embodiment of the method of the present invention described above and illustrated in FIG. 1 was used for practicing this eighth preferred embodiment, in which tantalum (Ta, whose melting point is about 2996° C.) was chosen as the first metal to be alloyed, and aluminum (Al, whose melting point is about 660° C.) was chosen as the second metal to be alloyed. Thus, a Ta-Al alloy was manufactured, in a generally similar fashion to that employed for the practice of the first preferred embodiment described above, in the following way.

First, a porous or interstice-ridden cylinder of substantially the same dimensions as before was made from the first metal to be alloyed, i.e. tantalum, by being compression molded from about 25.56 gm of substantially pure tantalum powder of mean particle size about 3 microns, so that the bulk density of the cylinder was approximately 8.3 gm/cm$^3$. Then this molded tantalum powder cylinder was preheated to a temperature of approximately 800° C., and was then placed in the mold cavity of the casting mold, which was itself preheated to a temperature of approximately 300° C. Then a quantity of about 450 cm$^3$ of substantially pure molten aluminum at a temperature of about 800° C. was poured into the mold cavity over and around the porous tantalum cylinder. Next, a pressure plunger was used, as in the practice of the first preferred embodiment, to pressurize the molten aluminum to a pressure of about 1000 kg/cm$^2$, so as to infiltrate said molten aluminum into the interstices of the tantalum cylinder in order to form a Ta-Al alloy mass by diffusion of the two metals into one another; and this pressure was maintained until the composite mass had cooled down and completely solidified. Then, as before, the composite mass was removed from the apparatus, and the portions thereof consisting substantially only of aluminum were machined away, so as to leave a Ta-Al alloy mass.

Figure 16:
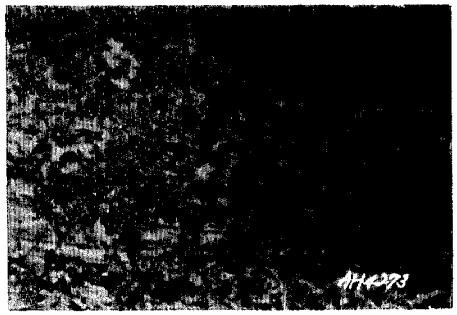
FIG. 16 is an optical microphotograph, similar to FIGS. 2, 7, 9, 11, 13, 14, and 15, of a section of a Ta-Al alloy mass produced according to an eighth preferred embodiment of the method of the present invention, enlarged at 100X magnification.

This Ta-Al alloy mass was then examined. Its macrocomposition by weight was found to be approximately 86.0% Ta and 14.0% Al. FIG. 16 is an optical photomicrograph of a central section thereof, enlarged at 100X magnification. From FIG. 16, it will be seen that according to this eighth preferred embodiment of the present invention it is possible to produce Ta-Al alloy which has uniform and relatively fine composition. Further, this Ta-Al alloy mass was examined by EPMA. From this examination, it was found that the alloy was composed of nuclei of substantially pure Ta, layers of $Ta_3Al$ surrounding these nuclei, and other layers of $TaAl_3$ surrounding these layers of $Ta_3Al$; and portions consisting substantially only of Al were not to be found. Thus it was verified that the diffusion process had well and sufficiently alloyed the tantalum and the aluminum to form a fine structured Ta-Al alloy mass. The preheating of the porous tantalum cylinder to a temperature substantially higher than the melting point of the aluminum to be alloyed therewith is again considered to have been particularly helpful in aiding with the diffusion of the molten aluminum and the tantalum into one another to form a well mixed alloy.

When this Ta-Al alloy mass was appropriately tested, it was found to have good heat resistance.

THE NINTH PREFERRED EMBODIMENT

A high pressure casting apparatus substantially the same as that utilized in the first preferred embodiment of the method of the present invention described above and illustrated in FIG. 1 was used for practicing this ninth preferred embodiment, in which iron (Fe, whose melting point is about 1535° C.) was chosen as the first metal to be alloyed, and aluminum (Al, whose melting point is about 660° C.) was chosen as the second metal to be alloyed. Thus, an Fe-Al alloy was manufactured, in a generally similar fashion to that employed for the practice of the first preferred embodiment described above, in the following way.

First, a porous or interstice-ridden cylinder of substantially the same dimensions as before was made from the first metal to be alloyed, i.e. iron, by being compression molded from about 12.02 gm of substantially pure iron powder of mean particle size about 35 microns, so that the bulk density of the cylinder was approximately 3.9 gm/cm$^3$. Then this molded iron powder cylinder was preheated to a temperature of approximately 750° C., and was then placed in the mold cavity of the casting mold, which was itself preheated to a temperature of approximately 300° C. Then a quantity of about 450 cm$^3$ of substantially pure molten aluminum at a temperature of about 750° C. was poured into the mold cavity over and around the porous iron cylinder. Next, a pressure plunger was used, as in the practice of the first preferred embodiment, to pressurize the molten aluminum to a pressure of about 1000 kg/cm$^2$, so as to infiltrate said molten aluminum into the interstices of the iron cylinder in order to form an Fe-Al alloy mass by diffusion of the two metals into one another; and this pressure was maintained until the composite mass had cooled down and completely solidified. Then, as before, the composite mass was removed from the apparatus, and the portions thereof consisting substantially only of aluminum were machined away, so as to leave an Fe-Al alloy mass.

Figure 17:
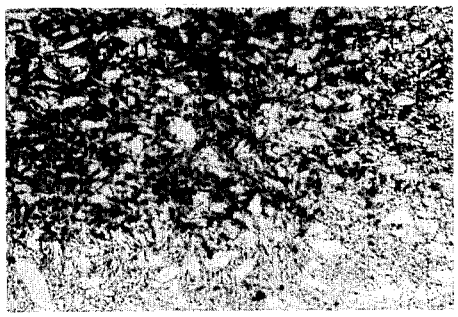
FIG. 17 is an optical microphotograph, similar to FIGS. 2, 7, 9, 11, 13, 14, 15, and 16, of a section of an Fe-Al alloy mass produced according to an ninth preferred embodiment of the method of the present invention, enlarged at 100X magnification.

This Fe-Al alloy mass was then examined. Its macrocomposition by weight was found to be approximately 74.5% Fe and 25.5% Al. FIG. 17 is an optical photomicrograph of a central section thereof, enlarged at 100X magnification. From FIG. 17, it will be seen that according to this ninth preferred embodiment of the present invention it is possible to produce Fe-Al alloy which has uniform and relatively fine composition. Further, this Fe-Al alloy mass was examined by EPMA. From this examination, it was found that the alloy was composed of nuclei of substantially pure Fe, layers of $Fe_2Al_3$ surrounding these nuclei, and other layers of $FeAl_2$ surrounding these layers of $Fe_2Al_3$; and portions consisting substantially only of Al were not to be found. Thus it was verified that the diffusion process had well and sufficiently alloyed the iron and the aluminum to form a fine structured Fe-Al alloy mass. The preheating of the porous iron cylinder to a temperature substantially higher than the melting point of the aluminum to be alloyed therewith is again considered to have been particularly helpful in aiding with the diffusion of the molten aluminum and the iron into one another to form a well mixed alloy.

When this Fe-Al alloy mass was appropriately tested, it was found to have good heat resistance and good strength at high temperature.

THE TENTH PREFERRED EMBODIMENT

A high pressure casting apparatus substantially the same as that utilized in the first preferred embodiment of the method of the present invention described above and illustrated in FIG. 1 was also used for practicing this tenth preferred embodiment likewise, in which niobium (Nb, whose melting point is about 2468° C.) was chosen as the first metal to be alloyed, and aluminum (Al, whose melting point is about 660° C.) was chosen as the second metal to be alloyed. Thus, an Nb-Al alloy was manufactured, in a generally similar fashion to that employed for the practice of the first preferred embodiment described above, in the following way.

First, a porous or interstice-ridden cylinder of substantially the same dimensions as before was made from the first metal to be alloyed, i.e. niobium, by being compression molded from about 13.18 gm of substantially pure niobium powder of mean particle size about 2 microns, so that the bulk density of the cylinder was approximately 4.28 gm/cm$^3$. Then this molded niobium powder cylinder was preheated to a temperature of approximately 600° C., and was then placed in the mold cavity of the casting mold, which was itself preheated to a temperature of approximately 300° C. Then a quantity of about 450 cm$^3$ of substantially pure molten aluminum at a temperature of about 800° C. was poured into the mold cavity over and around the porous niobium cylinder. Next, a pressure plunger was used, as in the practice of the first preferred embodiment, to pressurize the molten aluminum to a pressure of about 1000 kg/cm$^2$, so as to infiltrate said molten aluminum into the interstices of the niobium cylinder in order to form an Nb-Al alloy mass by diffusion of the two metals into one another; and this pressure was maintained until the composite mass had cooled down and completely solidified. Then, as before, the composite mass was removed from the apparatus, and the portions thereof consisting substantially only of aluminum were machined away, so as to leave an Nb-Al alloy mass.

Figure 18:
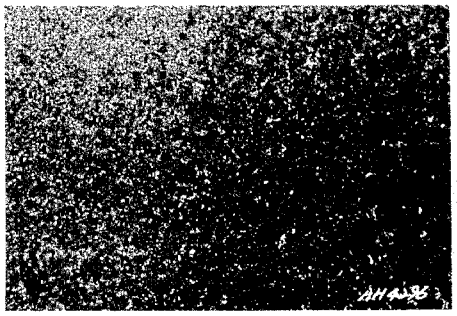
FIG. 18 is an optical microphotograph, similar to FIGS. 2, 7, 9, 11, 13, 14, 15, 16, and 17, of a section of an Nb-Al alloy mass produced according to a tenth preferred embodiment of the method of the present invention, enlarged at 100X magnification.

This Nb-Al alloy mass was then examined. Its macrocomposition by weight was found to be approximately 76.0% Nb and 24.0% Al. FIG. 18 is an optical photomicrograph of a central section thereof, enlarged at 100X magnification. From FIG. 18, it will be seen that according to this tenth preferred embodiment of the present invention it is possible to produce Nb-Al alloy which has uniform and relatively fine composition. Further, this Nb-Al alloy mass was examined by EPMA. From this examination, it was found that the alloy was composed of nuclei of substantially pure Nb, layers of $Nb_3Al$ surrounding these nuclei, and other layers of $NbAl_3$ surrounding these layers of $Nb_3Al$; and portions consisting substantially only of Al were not to be found. Thus it was verified that the diffusion process had well and sufficiently alloyed the niobium and the aluminum to form a fine structure Nb-Al alloy mass. The preheating of the porous niobium cylinder to a high temperature, although this temperature was lower than the melting point of the aluminum to be alloyed therewith, is again considered to have been particularly helpful in aiding with the diffusion of the aluminum and the niobium into one another to form a well mixed alloy.

When this Nb-Al alloy mass was appropriately tested, it was found to have good heat resistance and good strength at high temperature.

THE ELEVENTH PREFERRED EMBODIMENT

A high pressure casting apparatus substantially the same as that utilized in the first preferred embodiment of the method of the present invention described above and illustrated in FIG. 1 was also used for practicing this eleventh preferred embodiment likewise, in which vanadium (V, whose melting point is about 1900° C.+/−25° C.) was chosen as the first metal to be alloyed, and aluminum (Al, whose melting point is about 660° C.) wash chosen as the second metal to be alloyed. Thus, a V-Al alloy was manufactured, in a generally similar fashion to that employed for the practice of the first preferred embodiment described above, in the following way.

First, a porous or interstice-ridden cylinder of substantially the same dimensions as before was made from the first metal to be alloyed, i.e. vanadium, by being compression molded from about 9.4 gm of substantially pure vanadium powder of mean particle size about 35 microns, so that the bulk density of the cylinder was approximately 3.06 gm/cm$^3$. Then this molded vanadium powder cylinder was preheated to a temperature of approximately 800° C., and was then placed in the mold cavity of the casting mold, which was itself preheated to a temperature of approximately 300° C. Then a quantity of about 450 cm$^3$ of substantially pure molten aluminum at a temperature of about 800° C. was poured into the mold cavity over and around the porous vanadium cylinder. Next, a pressure plunger was used, as in the practice of the first preferred embodiment, to pressurize the molten aluminum to a pressure of about 1000 kg/cm$^2$, so as to infiltrate said molten aluminum into the interstices of the vanadium cylinder in order to form a V-Al alloy mass by diffusion of the two metals into one another; and this pressure was maintained until the composite mass had cooled down and completely solidified. Then, as before, the composite mass was removed from the apparatus, and the portions thereof consisting substantially only of aluminum were machined away, so as to leave a V-Al alloy mass.

This V-Al alloy mass was then examined. Its macrocomposition by weight was found to be approximately 69.3% V and 30.7% Al. No particular photomicrograph relating to this eleventh preferred embodiment is provided, but it was found that, similarly to the other preferred embodiments described above, according to this eleventh preferred embodiment of the present invention it is possible to produce V-Al alloy which has uniform and relatively fine composition. Further, this V-Al alloy mass was examined by EPMA. From this examination, it was found that the alloy was composed of nuclei of substantially pure V, layers of $Al_5V_8$ surrounding these nuclei, and other layers of $Al_3V$ surrounding these layers of $Al_5V_8$; and portions consisting substantially only of Al were not to be found. Thus it was verified that the diffusion process had well and sufficiently alloyed the vanadium and the aluminum to form a fine structured V-Al alloy mass. The preheating of the porous vanadium cylinder to a temperature substantially higher than the melting point of the aluminum to be alloyed therewith is again considered to have been particularly helpful in aiding with the diffusion of the molten aluminum and the vanadium into one another to form a well mixed alloy.

When this V-Al alloy mass was appropriately tested, it was found to have good heat resistance.

THE TWELFTH PREFERRED EMBODIMENT

A high pressure casting apparatus substantially the same as that utilized in the first preferred embodiment of the method of the present invention described above and illustrated in FIG. 1 was also used for practicing this twelfth preferred embodiment likewise, in which aluminum (Al, whose melting pint is about 660° C.) was chosen as the first metal to be alloyed, and tin (Sn, whose melting point is about 231.9° C.) was chosen as the second metal to be alloyed. Thus, an Al-Sn alloy was manufactured, in a generally similar fashion to that employed for the practice of the first preferred embodiment described above, in the following way.

First, a porous or interstice-ridden cylinder of substantially the same dimensions as before was made from the first metal to be alloyed, i.e. aluminum, by being compression molded from about 4.16 gm of substantially pure aluminum powder of mean particle size about 44 microns, so that the bulk density of the cylinder was approximately 1.35 gm/cm$^3$. Then this molded aluminum powder cylinder was preheated to a temperature of approximately 400° C., and was then placed in the mold cavity of the casting mold, which was itself preheated to a temperature of approximately 100° C. Then a quantity of about 200 cm$^3$ of substantially pure molten tin at a temperature of about 350° C. was poured into the mold cavity over and around the porous aluminum cylinder. Next, a pressure plunger was used, as in the practice of the first preferred embodiment, to pressurize the molten tin to a pressure of about 1000 kg/cm$^2$, so as to infiltrate said molten tin into the interstices of the aluminum cylinder in order to form an Al-Sn alloy mass by diffusion of the two metals into one another; and this pressure was maintained until the composite mass had cooled down and completely solidified. Then, as before, the composite mass was removed from the apparatus, and the portions thereof consisting substantially only of tin were machined away, so as to leave an Al-Sn alloy mass.

This Al-Sn alloy mass was then examined. Its macrocomposition by weight was found to be approximately 27.0% Al and 73.0% Sn. No particular photomicrograph relating to this twelfth preferred embodiment is provided either, but it was found that, similarly to the other preferred embodiments described above, according to this twelfth preferred embodiment of the present invention it is possible to produce Al-Sn alloy which has uniform and relatively fine composition. Further, this Al-Sn alloy mass was examined by EPMA. From this examination, it was found that the alloy was composed of nuclei of substantially pure Al, layers of $AlSn_3$ surrounding these nuclei, and other layers of $Al_3Sn$ surrounding these layers of $AlSn_3$; and portions consisting substantially only of Sn were not to be found. Thus it was verified that the diffusion process had well and sufficiently alloyed the aluminum and the tin to form a fine structure Al-Sn alloy mass. The preheating of the porous aluminum cylinder to a temperature substantially higher than the melting point of the tin to be alloyed therewith is again considered to have been particularly helpful in aiding with the diffusion of the molten tin and the aluminum into one another to form a well mixed alloy.

When this Al-Sn alloy mass was appropriately tested, it was found to have good abrasion resistance.

THE THIRTEENTH PREFERRED EMBODIMENT

A high pressure casing apparatus substantially the same as that utilized in the first preferred embodiment of the method of the present invention described above and illustrated in FIG. 1 was also used for practicing this thirteenth preferred embodiment likewise, in which zinc (Zn, whose melting point is about 419.5° C.) was chosen as the first metal to be alloyed, and tin (Sn, whose melting point is about 231.9° C.) was chosen as the second metal to be alloyed. Thus, a Zn-Sn alloy was manufactured, in a generally similar fashion to that employed for the practice of the first preferred embodiment described above, in the following way.

First, a porous or interstice-ridden cylinder of substantially the same dimensions as before was made from the first metal to be alloyed, i.e. zinc, by being compression molded from about 11.05 gm of substantially pure zinc powder of mean particle size about 15 microns, so that the bulk density of the cylinder was approximately 3.57 gm/cm$^3$. Then this molded zinc powder cylinder was preheated to a temperature of approximately 300° C., and was then placed in the mold cavity of the casting mold, which was itself preheated to a temperature of approximately 100° C. Then a quantity of about 200 cm$^3$ of substantially pure molten tin at a temperature of about 350° C. was poured into the mold cavity over and around the porous zinc cylinder. Next, a pressure plunger was used, as in the practice of the first preferred embodiment, to pressurize the molten tin to a pressure of about 1000 kg/cm$^2$, so as to infiltrate said molten tin into the interstices of the zinc cylinder in order to form a Zn-Sn alloy mass by diffusion of the two metals into one another; and this pressure was maintained until the composite mass had cooled down and completely solidified. Then, as before, the composite mass was removed from the apparatus, and the portions thereof consisting substantially only of tin were machined away, so as to leave a Zn-Sn alloy mass.

This Zn-Sn alloy mass was then examined. Its macrocomposition by weight was found to be approximately 49.6% Zn and 50.4% Sn. No particular photomicrograph relating to this thirteenth preferred embodiment is provided either, but it was found that, similarly to the other preferred embodiments described above, according to this thirteenth preferred embodiment of the present invention it is possible to produce Zn-Sn alloy which has uniform and relatively fine composition. Further, this Zn-Sn alloy mass was examined by EPMA. From this examination, it was found that the alloy was composed of nuclei of substantially pure Zn, layers of $Zn_7Sn_2$ surrounding these nuclei, and other layers of $Zn_3Sn$ surrounding these layers of $Zn_7Sn_2$; and portions consisting substantially only of Sn were not to be found. Thus it was verified that the diffusion process had well and sufficiently alloyed the zinc and the tin to form a fine structured Zn-Sn alloy mass. The preheating of the porous zinc cylinder to a temperature substantially higher than the melting point of the tin to be alloyed therewith is again considered to have been particularly helpful in aiding with the diffusion of the molten tin and the zinc into one another to form a well mixed alloy.

When this Zn-Sn alloy mass was appropriately tested, it was found to have good abrasion resistance.

THE FOURTEENTH PREFERRED EMBODIMENT

A high pressure casting apparatus substantially the same as that utilized in the first preferred embodiment of the method of the present invention described above and illustrated in FIG. 1 was also used for practicing this fourteenth preferred embodiment likewise, in which tungsten (W, whose melting point is about 3410° C.) was chosen as the first metal to be alloyed, and aluminum (Al, whose melting point is about 660° C.) was chosen as the second metal to be alloyed. Thus, a W-Al alloy was manufactured, in a generally similar fashion to that employed for the practice of the first preferred embodiment described above, in the following way.

First, a porous or interstice-ridden cylinder of substantially the same dimensions as before was made from the first metal to be alloyed, i.e. tungsten, by being compression molded from about 14.9 gm of substantially pure tungsten powder of mean particle size about 0.5 microns, so that the bulk density of the cylinder was approximately 4.83 gm/cm$^3$. Then this molded tungsten powder cylinder was preheated to a temperature of approximately 800° C., and was then placed in the mold cavity of the casting mold, which was itself preheated to a temperature of approximately 300° C. Then a quantity of about 450 cm$^3$ of substantially pure molten aluminum at a temperature of about 800° C. was poured into the mold cavity over and around the porous tungsten cylinder. Next, a pressure plunger was used, as in the practice of the first preferred embodiment, to pressurize the molten aluminum to a pressure of about 1000 kg/cm$^2$, so as to infiltrate said molten aluminum into the interstices of the tungsten cylinder in order to form a W-Al alloy mass by diffusion of the two metals into one another; and this pressure was maintained until the composite mass had cooled down and completely solidified. Then, as before, the composite mass was removed from the apparatus, and the portions thereof consisting substantially only of aluminum were machined away, so as to leave a W-Al alloy mass.

This W-Al alloy mass was then examined. Its macrocomposition by weight was found to be approximately 70.5% W and 29.5% Al. No particular photomicrograph relating to this fourteenth preferred embodiment is provided either, but it was found that, similarly to the other preferred embodiments described above, according to this fourteenth preferred embodiment of the present invention it is possible to produce W-Al alloy which has uniform and relatively fine composition. Further, this W-Al alloy mass was examined by EPMA. From this examination, it was found that the alloy was composed of nuclei of substantially pure W, layers of WAl surrounding these nuclei, and other layers of $WAl_2$ surrounding these layers of WAl; and portions consisting substantially only of Al were not to be found. Thus it was verified that the diffusion process had well and sufficiently alloyed the tungsten and the aluminum to form a fine structured W-Al alloy mass. The preheating of the porous tungsten cylinder to a temperature substantially higher than the melting point of the aluminum to be alloyed therewith is again considered to have been particularly helpful in aiding with the diffusion of the molten aluminum and the tungsten into one another to form a well mixed alloy.

When this W-Al alloy mass was appropriately tested, it was found to have superior heat resistance.

THE FIFTEENTH PREFERRED EMBODIMENT

A cold chamber die casting machine substantially the same as that utilized in the second preferred embodiment of the method of the present invention described above and illustrated in FIG. 6 was used for practicing this fifteenth preferred embodiment, in which molybdenum (Mo, whose melting point is about 2610° C.) was chosen as the first metal to be alloyed, and zinc (Zn, whose melting point is about 419.5° C.) was chosen as the second metal to be alloyed. Thus, an Mo-Zn alloy was manufactured, in a generally similar fashion to that employed for the practice of the second preferred embodiment described above, in the following way.

First, a porous or interstice-ridden cylinder of substantially the same dimensions as before was made from the first metal to be alloyed, i.e. molybdenum, by being compression molded from about 15.74 gm of substantially pure molybdenum powder of mean particle size about 2.85 microns, so that the bulk density of the cylinder was approximately 5.11 gm/cm$^3$. Then this molded molybdenum powder cylinder was preheated to a temperature of approximately 800° C., and was then placed in the cavity of the movable die which was itself preheated to a temperature of approximately 200° C. Then a quantity of about 300 cm$^3$ of substantially pure molten zinc at a temperature of about 550° C. was introduced into the apparatus, as before, and this molten zinc was injected into said cavity of said movable die, over and around the porous molybdenum cylinder, by the pressure plunger being used, as in the practice of the second preferred embodiment, to pressurize the molten zinc to a pressure of about 500 kg/cm$^2$, so as to infiltrate said molten zinc into the interstices of the molybdenum cylinder in order to form an Mo-Zn alloy mass by diffusion of the two metals into one another; and this pressure was maintained until the composite mass had cooled down and completely solidified. Then, as before, the composite mass was removed from the apparatus, and the portions thereof consisting substantially only of zinc were machined away, so as to leave an Mo-Zn alloy mass.

Figure 19:
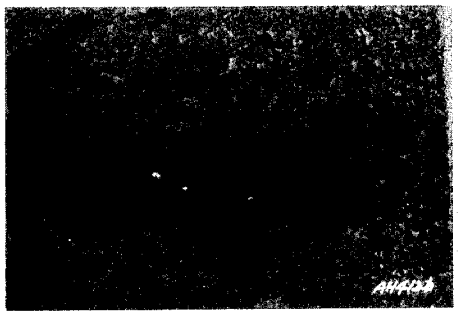
FIG. 19 is an optical microphotograph, similar to FIGS. 2, 7, 9, 11, 13, 14, 15, 16, 17, and 18, of a section of an Mo-Zn alloy mass produced according to a fifteenth preferred embodiment of the method of the present invention, enlarged at 100X magnification.

This Mo-Zn alloy mass was then examined. Its macro-composition by weight was found to be approximately 58.9% Mo and 41.1% Zn. FIG. 19 is an optical photomicrograph of a central section thereof, enlarged at 100X magnification. From FIG. 19, it will be seen that according to this fifteenth preferred embodiment of the present invention it is possible to produce Mo-Zn alloy which has uniform and relatively fine composition. Further, this Mo-Zn alloy mass was examined by EPMA. From this examination, it was found that the alloy was composed of nuclei of substantially pure Mo, layers of $Mo_2Zn$ surrounding these nuclei, and other layers of $MoZn_3$ surrounding these layers of $Mo_2Zn$; and portions consisting substantially only of Zn were not to be found. Thus it was verified that the diffusion process had well and sufficiently alloyed the molybdenum and the zinc to form a fine structured Mo-Zn alloy mass. The preheating of the porous molybdenum cylinder to a temperature substantially higher than the melting point of the zinc to be alloyed therewith is again considered to have been particularly helpful in aiding with the diffusion of the molten zinc and the molybdenum into one another to form a well mixed alloy.

When this Mo-Zn alloy mass was approximately tested, it was found to have superior heat resistance.

THE SIXTEENTH PREFERRED EMBODIMENT

A cold chamber die casing machine substantially the same as that utilized in the second preferred embodiment of the method of the present invention described above and illustrated in FIG. 6 was again used for practicing this sixteenth preferred embodiment, in which gold (Au, whose melting point is about 1063° C.) was chosen as the first metal to be alloyed, and magnesium (Mg, whose melting point is about 650° C.+/−2° C.) was chosen as the second metal to be alloyed. Thus, an Au-Mg alloy was manufactured, in a generally similar fashion to that employed for the practice of the second preferred embodiment described above, in the following way.

First, a porous or interstice-ridden cylinder of substantially the same dimensions as before was made from the first metal to be alloyed, i.e. gold, by being compression molded from about 29.9 gm of substantially pure gold powder of mean particle size about 60 microns, so that the bulk density of the cylinder was approximately 9.66 gm/cm$^3$. Then this molded gold powder cylinder was preheated to a temperature of approximately 600° C., and was then placed in the cavity of the movable die which was itself preheated to a temperature of approximately 300° C. Then a quantity of about 500 cm$^3$ of substantially pure molten magnesium at a temperature of about 750° C. was introduced into the apparatus, as before, and this molten magnesium was injected into said cavity of said movable die, over and around the porous gold cylinder, by the pressure plunger being used, as in the practice of the second preferred embodiment, to pressurize the molten magnesium to a pressure of about 800 kg/cm$^2$, so as to infiltrate said molten magnesium into the interstices of the gold cylinder in order to form an Au-Mg alloy mass by diffusion of the two metals into one another; and this pressure was maintained until the composite mass had cooled down and completely solidified. Then, as before, the composite mass was removed from the apparatus, and the portions thereof consisting substantially only of magnesium were machined away, so as to leave an Au-Mg alloy mass.

This Au-Mg alloy mass was then examined. Its macro-composition by weight was found to be approximately 91.8% Au and 8.2% Mg. No particular photomicrograph relating to this sixteenth preferred embodiment is provided, but it was found that, similarly to the other preferred embodiments described above, according to this sixteenth preferred embodiment of the present invention it is possible to produce Au-Mg alloy which has uniform and relatively fine composition. Further, this Au-Mg alloy mass was examined by EPMA. From this examination, it was found that the alloy was composed of nuclei of substantially pure Au, layers of $MgAu_3$ surrounding these nuclei, and other layers of $Mg_5Au_2$ surrounding these layers of $MgAu_3$; and portions consisting substantially only of Mg were not to be found. Thus it was verified that the diffusion process had well and sufficiently alloyed the gold and the magnesium to form a fine structured Au-Mg alloy mass. The preheating of the porous gold cylinder to a temperature substantially higher than the melting point of the magnesium to be alloyed therewith is again considered to have been particularly helpful in aiding with the diffusion of the molten magnesium and the gold into one another to form a well mixed alloy.

When this Au-Mg alloy mass was appropriately tested, it was found to have superior corrosion resistance.

THE SEVENTEENTH PREFERRED EMBODIMENT

A cold chamber die casting machine substantially the same as that utilized in the second preferred embodiment of the method of the present invention described above and illustrated in FIG. 6 was again used for practicing this seventeenth preferred embodiment, in which zirconium (Zr, whose melting point is about 1852° C.) was chosen as the first metal to be alloyed, and aluminum (Al, whose melting point is about 660° C.) was chosen as the second metal to be alloyed. Thus, a Zr-Al alloy was manufactured, in a generally similar fashion to that employed for the practice of the second preferred embodiment described above, in the following way.

First, a porous or interstice-ridden cylinder of substantially the same dimensions as before was made from the first metal to be alloyed, i.e. zirconium, by being compression molded from about 9.93 gm of substantially pure zirconium powder of mean particle size about 35 microns, so that the bulk density of the cylinder was approximately 3.23 gm/cm$^3$. Then this molded zirconium powder cylinder was preheated to a temperature of approximately 800° C., and was then placed in the cavity of the movable die which was itself preheated to a temperature of approximately 300° C. Then a quantity of about 500 cm$^3$ of substantially pure molten aluminum at a temperature of about 800° C. was introduced into the apparatus, as before, and this molten aluminum was injected into said cavity of said movable die, over and around the porous zirconium cylinder, by the pressure plunger being used, as in the practice of the second preferred embodiment, to pressurize the molten aluminum to a pressure of about 800 kg/cm$^2$, so as to infiltrate said molten aluminum into the interstices of the zirconium cylinder in order to form a Zr-Al alloy mass by diffusion of the two metals into one another; and this pressure was maintained until the composite mass had cooled down and completely solidified. Then, as before, the composite mass was removed from the apparatus, and the portions thereof consisting substantially only of aluminum were machined away, so as to leave a Zr-Al alloy mass.

This Zr-Al alloy mass was then examined. Its macro-composition by weight was found to be approximately 70.5% Zr and 29.5% Al. No particular photomicrograph relating to this seventeenth preferred embodiment is provided, but it was found that, similarly to the other preferred embodiments described above, according to this seventeenth preferred embodiment of the present invention it is possible to produce Zr-Al alloy which has uniform and relatively fine composition. Further, this Zr-Al alloy mass was examined by EPMA. From this examination, it was found that the alloy was composed of nuclei of substantially pure Zr, layers of $Zr_3Al$ surrounding these nuclei, and other layers of $ZrAl_2$ surrounding these layers of $Zr_3Al$; and portions consisting substantially only of Al were not to be found. Thus it was verified that the diffusion process had well and sufficiently alloyed the zirconium and the aluminum to form a fine structured Zr-Al alloy mass. The preheating of the porous zirconium cylinder to a temperature substantially higher than the melting point of the aluminum to be alloyed therewith is again considered to have been particularly helpful in aiding with the diffusion of the molten aluminum and the zirconium into one another to form a well mixed alloy.

When this Zr-Al alloy mass was appropriately tested, it was found to have superior heat resistance.

THE EIGHTEENTH PREFERRED EMBODIMENT

A high pressure casting apparatus substantially the same as that utilized in the first preferred embodiment of the method of the present invention described above and illustrated in FIG. 1 was used for practicing this eighteenth preferred embodiment, in which manganese (Mn, whose melting point is about 1245° C.) was chosen as the first metal to be alloyed, and aluminum alloy of JIS standard AC4C (containing Si as a principal constituent, and with a melting point of about 580° C.) was chosen as the second metal to be alloyed. Thus, an Al-Mn-Si alloy was manufactured, in a generally similar fashion to that employed for the practice of the first preferred embodiment described above, in the following way.

First, a porous or interstice-ridden cylinder of substantially the same dimensions as before was made from the first metal to be alloyed, i.e. manganese, by being compression molded from about 11.46 gm of substantially pure manganese powder of mean particle size about 40 microns, so that the bulk density of the cylinder was approximately 3.72 gm/cm$^3$. Then this molded manganese powder cylinder was preheated to a temperature of approximately 800° C., and was then placed in the mold cavity of the casting mold, which was itself preheated to a temperature of approximately 300° C. Then a quantity of about 450 cm$^3$ of substantially pure molten aluminum JIS AC4C alloy at a temperature of about 750° C. was poured into the mold cavity over and around the porous manganese cylinder. Next, a pressure plunger was used, as in the practice of the first preferred embodiment, to pressurize the molten aluminum alloy to a pressure of about 1000 kg/cm$^2$, so as to infiltrate said molten aluminum alloy into the interstices of the manganese cylinder in order to form an Al-Mn-Si alloy mass by diffusion of the two metals into one another; and this pressure was maintained until the composite mass had cooled down and completely solidified. Then, as before, the composite mass was removed from the apparatus, and the portions thereof consisting substantially only of aluminum alloy were machined away, so as to leave an Al-Mn-Si alloy mass.

Figure 20:
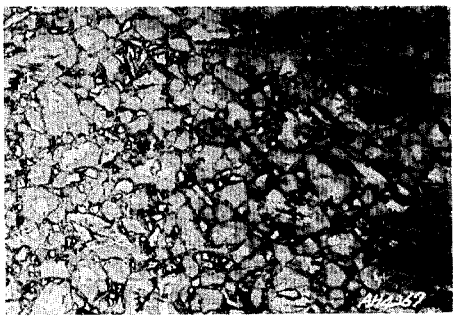
FIG. 20 is an optical microphotograph, similar to FIGS. 2, 7, 9, 11, and 13 through 19, of a section of an Al-Mn-Si alloy mass produced according to an eighteenth preferred embodiment of the method of the present invention, enlarged at 100X magnification.

This Al-Mn-Si alloy mass was then examined. Its macro-composition by weight was found to be approximately 73.4% Mn, 24.66% Al, and 1.86% Si (other constituents being Mg and impurities). FIG. 20 is an optical photomicrograph of a central section thereof, enlarged at 100X magnification. From FIG. 20, it will be seen that according to this eighteenth preferred embodiment of the present invention it is possible to produce Al-Mn-Si alloy which has uniform and relatively fine composition. Further, this Al-Mn-Si alloy mass was examined by EPMA. From this examination, it was found that the alloy was composed of nuclei of substantially pure Mn, layers of MnAl surrounding these nuclei, and other layers of $MnAl_3$ surrounding these layers of MnAl; and portions consisting substantially only of Al alloy were not to be found. Thus it was verified that the diffusion process had well and sufficiently alloyed the manganese and the aluminum alloy to form a fine structured Al-Mn-Si alloy mass. The preheating of the porous manganese cylinder to a temperature substantially higher than the melting point of the aluminum alloy to be alloyed therewith is again considered to have been particularly helpful in aiding with the diffusion of the molten aluminum alloy and the manganese into one another to form a well mixed alloy.

When this Al-Mn-Si alloy mass was appropriately tested, it was found to have good corrosion resistance.

THE NINETEENTH PREFERRED EMBODIMENT

A high pressure casting apparatus substantially the same as that utilized in the first preferred embodiment of the method of the present invention described above and illustrated in FIG. 1 was used for practicing this nineteenth preferred embodiment, in which chromium (Cr, whose melting point is about 1875° C.) was chosen as the first metal to be alloyed, and aluminum alloy of JIS standard AC4C (containing Si as a principal constituent, and with a melting point of about 580° C.) was chosen as the second metal to be alloyed. Thus, an Al-Cr-Si alloy was manufactured, in a generally similar fashion to that employed for the practice of the first preferred embodiment described above, in the following way.

First, a porous or interstice-ridden cylinder of substantially the same dimensions as before was made from the first metal to be alloyed, i.e. chromium, by being compression molded from about 11.08 gm of substantially pure chromium powder of mean particle size about 2 microns, so that the bulk density of the cylinder was approximately 3.6 gm/cm$^3$. Then this molded chromium powder cylinder was preheated to a temperature of approximately 600° C., and was then placed in the mold cavity of the casting mold, which was itself preheated to a temperature of approximately 300° C. Then a quantity of about 450 cm$^3$ of substantially pure molten aluminum JIS AC4C alloy at a temperature of about 750° C. was poured into the mold cavity over and around the porous chromium cylinder. Next, a pressure plunger was used, as in the practice of the first preferred embodiment, to pressurize the molten aluminum alloy to a pressure of about 1000 kg/cm$^2$, so as to infiltrate said molten aluminum alloy into the interstices of the chromium cylinder in order to form an Al-Cr-Si alloy mass by diffusion of the two metals into one another; and this pressure was maintained until the composite mass had cooled down and completely solidified. Then, as before, the composite mass was removed from the apparatus, and the portions thereof consisting substantially only of aluminum alloy were machined away, so as to leave an Al-Cr-Si alloy mass.

Figure 21:
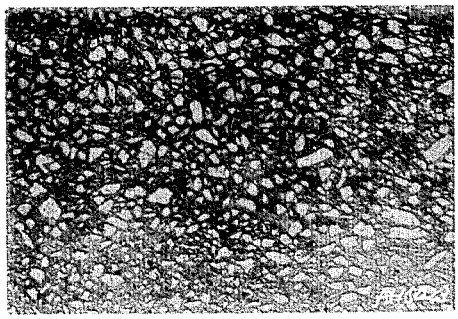
FIG. 21 is an optical microphotograph, similar to FIGS. 2, 7, 9, 11, and 13 through 20, of a section of an Al-Cr-Si alloy mass produced according to a nineteenth preferred embodiment of the method of the present invention, enlarged at 100X magnification.

This Al-Cr-Si alloy mass was then examined. Its macro-composition by weight was found to be approximately 72.7% Cr, 25.31% Al, and 1.91% Si (other constituents being Mg and impurities). FIG. 21 is an optical photomicrograph of a central section thereof, enlarged at 100X magnification. From FIG. 21, it will be seen that according to this nineteenth preferred embodiment of the present invention it is possible to produce Al-Cr-Si alloy which has uniform and relatively fine composition. Further, this Al-Cr-Si alloy mass was examined by EPMA. From this examination, it was found that the alloy was composed of nuclei of substantially pure Cr, layers of $Cr_3Al$ surrounding these nuclei, and other layers of $Cr_2Al_5$ surrounding these layers of $Cr_3Al$; and portions consisting substantially only of Al alloy were not to be found. Thus it was verified that the diffusion process had well and sufficiently alloyed the chromium and the aluminum alloy to form a fine structured Al-Cr-Si alloy mass. The preheating of the porous chromium cylinder to a temperature higher (albeit only slightly higher) than the melting point of the aluminum alloy to be alloyed therewith is again considered to have been particularly helpful in aiding with the diffusion of the molten aluminum alloy and the chromium into one another to form a well mixed alloy.

When this Al-Cr-Si alloy mass was appropriately tested, it was found to have very superior heat resistance.

THE TWENTIETH PREFERRED EMBODIMENT

A high pressure casting apparatus substantially the same as that utilized in the first preferred embodiment of the method of the present invention described above and illustrated in FIG. 1 was used for practicing this twentieth preferred embodiment, in which silicon (Si, whose melting point is about 1410° C.) was chosen as the first metal to be alloyed, and magnesium alloy of ASTM standard AZ91C (containing Si, Al, and Zn as principal additional constituents, and with a melting point of about 570° C.) was chosen as the second metal to be alloyed. Thus, an Si-Mg-Al-Zn alloy was manufactured, in a generally similar fashion to that employed for the practice of the first preferred embodiment described above, in the following way.

First, a porous or interstice-ridden cylinder of substantially the same dimensions as before was made from the first metal to be alloyed, i.e. silicon, by being compression molded from about 3.6 gm of substantially pure silicon powder of mean particle size about 60 microns, so that the bulk density of the cylinder was approximately 1.17 gm/cm$^3$. Then this molded silicon powder cylinder was preheated to a temperature of approximately 600° C., and was then placed in the mold cavity of the casting mold, which was itself preheated to a temperature of approximately 300° C. Then a quantity of about 450 cm$^3$ of substantially pure molten magnesium ASTM AZ91C alloy at a temperature of about 700° C. was poured into the mold cavity over and around the porous silicon cylinder. Next, a pressure plunger was used, as in the practice of the first preferred embodiment, to pressurize the molten magnesium alloy to a pressure of about 750 kg/cm$^2$, so as to infiltrate said molten magnesium alloy into the interstices of the silicon cylinder in order to form an Si-Mg-Al-Zn alloy mass by diffusion of the two metals into one another; and this pressure was maintained until the composite mass had cooled down and completely solidified. Then, as before, the composite mass was removed from the apparatus, and the portions thereof consisting substantially only of the original magnesium alloy were machined away, so as to leave an Si-Mg-Al-Zn alloy mass.

Figure 22:
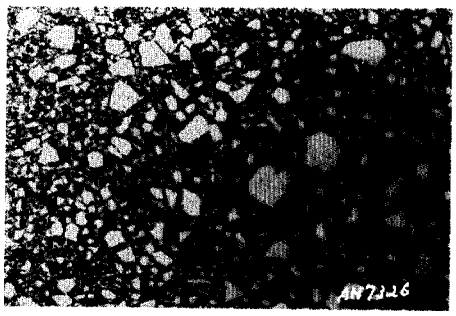
FIG. 22 is an optical microphotograph, similar to FIGS. 2, 7, 9, 11, and 13 through 21, of a section of an Si-Mg-Al-Zn alloy mass produced according to a twentieth preferred embodiment of the method of the present invention, enlarged at 100X magnification.

This Si-Mg-Al-Zn alloy mass was then examined. Its macrocomposition by weight was found to be approximately 57.3% Si, 38.43% Mg, 3.84% Al, and 0.43% Zn. FIG. 22 is an optical photomicrograph of a central section thereof, enlarged at 100X magnification. From FIG. 22, it will be seen that according to this twentieth preferred embodiment of the present invention it is possible to produce Si-Mg-Al-Zn alloy which has uniform and relatively fine composition. Further, this Si-Mg-Al-Zn alloy mass was examined by EPMA. From this examination, it was found that the alloy was composed of nuclei of substantially pure Si, layers of $Si_3Mg_2$ surrounding these nuclei, and other layers of $SiMg_2$ surrounding these layers of $Si_3Mg_2$; and portions consisting substantially only of the original magnesium alloy were not to be found. Thus it was verified that the diffusion process had well and sufficiently alloyed the silicon and the magnesium alloy to form a fine structure Si-Mg-Al-Zn alloy mass. The preheating of the porous silicon cylinder to a temperature higher (albeit only slightly higher) than the melting point of the magnesium alloy to be alloyed therewith is again considered to have been particularly helpful in aiding with the diffusion of the molten magnesium alloy and the silicon into one another to form a well mixed alloy.

When this Si-Mg-Al-Zn alloy mass was appropriately tested, it was found to have superior abrasion resistance.

THE TWENTY-FIRST PREFERRED EMBODIMENT

A cold chamber die casting machine substantially the same as that utilized in the second preferred embodiment of the method of the present invention described above and illustrated in FIG. 6 was again used for practicing this twenty-first preferred embodiment, in which nickel (Ni, whose melting point is about 1453° C.) was chosen as the first metal to be alloyed, and zinc alloy of JIS standard ZDC1 (with a melting point of about 419.5° C.) was chosen as the second metal to be alloyed. Thus, an Ni-Zn-Al-Cu alloy was manufactured, in a generally similar fashion to that employed for the practice of the second preferred embodiment described above, in the following way.

First, a porous or interstice-ridden cylinder of substantially the same dimensions as before was made from the first metal to be alloyed, i.e. nickel, by being compression molded from about 13.7 gm of substantially pure nickel powder of mean particle size about 1 micron, so that the bulk density of the cylinder was approximately 4.45 gm/cm$^3$. Then this molded nickel powder cylinder was preheated to a temperature of approximately 400° C., and was then placed in the cavity of the movable die which was itself preheated to a temperature of approximately 200° C. Then a quantity of about 300 cm$^3$ of substantially pure molten zinc alloy of JIS standard ZDC1 at a temperature of about 550° C. was introduced into the apparatus, as before, and this molten zinc alloy was injected into said cavity of said movable die, over and around the porous nickel cylinder, by the pressure plunger being used, as in the practice of the second preferred embodiment, to pressurize the molten zinc alloy to a pressure of about 750 kg/cm$^2$, so as to infiltrate said molten zinc alloy into the interstices of the nickel cylinder in order to form an Ni-Zn-Al-Cu alloy mass by diffusion of the two metals into one another; and this pressure was maintained until the composite mass had cooled down and completely solidified. Then, as before, the composite mass was removed from the apparatus, and the portions thereof consisting substantially only of the original zinc alloy were machined away, so as to leave an Ni-Zn-Al-Cu alloy mass.

Figure 23:
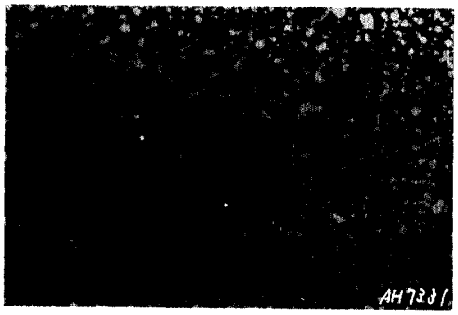
FIG. 23 is an optical microphotograph, similar to FIGS. 2, 7, 9, 11, and 13 through 22, of a section of an Ni-Zn-Al-Cu alloy mass produced according to a twenty-first preferred embodiment of the method of the present invention, enlarged this time at 400X magnification.

This Ni-Zn-Al-Cu alloy mass was then examined. Its macro-composition by weight was found to be approximately 55.5% Ni, 42.34% Zn, 1.71% Al, and 0.45% Cu. FIG. 23 is an optical photomicrograph of a central section thereof, enlarged this time at 400X magnificaton. From FIG. 23, it will be seen that according to this twenty-first preferred embodiment of the present invention it is possible to produce Ni-Zn-Al-Cu alloy which has uniform and relatively fine composition. Further, this Ni-Zn-Al-Cu alloy mass was examined by EPMA. From this examination, it was found that the alloy was composed of nuclei of substantially pure Ni, layers of $Ni_3Zn_2$ surrounding these nuclei, and other layers of $Ni_3Zn_5$ surrounding these layers of $Ni_3Zn_2$; and portions consisting substantially only of the original zinc alloy were not to be found. Thus it was verified that the diffusion process had well and sufficiently alloyed the nickel and the zinc alloy to form a fine structured Ni-Zn-Al-Cu alloy mass. The preheating of the porous nickel cylinder, albeit to a temperature lower than the melting point of the zinc alloy to be alloyed therewith, is again considered to have been particularly helpful in aiding with the diffusion of the molten zinc alloy and the nickel into one another to form a well mixed alloy.

When this Ni-Zn-Al-Cu alloy mass was appropriately tested, it was found to have superior corrosion resistance and vibration property.

THE TWENTY-SECOND PREFERRED EMBODIMENT

A horizontal centrifugal casting apparatus substantially the same as that utilized in the third preferred embodiment of the method of the present invention described above and illustrated in FIG. 8 was used for practicing this twenty-second preferred embodiment, in which copper and zinc alloy (containing about 60% copper and 40% zinc, with a melting point of about 900° C.) was chosen as the first metal to be alloyed, and aluminum (with a melting point of about 660° C.) was chosen as the second metal to be alloyed. Thus, a Cu-Zn-Al alloy was manufactured, in a generally similar fashion to that employed for the practice of the third preferred embodiment described above, in the following way.

First, a porous or interstice-ridden rectangular parallelepiped of substantially the same dimensions as in the third preferred embodiment was made from the first metal to be alloyed, i.e. copper and zinc alloy, by being compression molded from about 9.85 gm of copper and zinc alloy in discontinuous fiber form (with mean fiber diameter about 80 microns and mean fiber length about 3 mm), so that the bulk density of the rectangular parallelepiped was approximately 2.46 gm/cm$^3$. Then this molded copper and zinc alloy fiber rectangular parallelepiped was preheated to a temperature of approximately 800° C., and was then placed in the rotatable casting mold which was itself preheated to a temperature of approximately 200° C. Then a quantity of about 800 cm$^3$ of substantially pure molten aluminum at a temperature of about 800° C. was introduced into the apparatus, and, as in the practice of the second preferred embodiment, the casting mold was spun, at a rotational speed of about 200 revolutions per minute, so as to pressurize the molten aluminum and so as to infiltrate said molten aluminum into the interstices of the copper and zinc alloy rectangular parallelepiped in order to form a Cu-Zn-Al alloy mass by diffusion of the two metals into one another; and this spinning was maintained until the composite mass had cooled down and completely solidified. Then, as before, the composite mass was removed from the apparatus, and the portions thereof consisting substantially only of the original aluminum were machined away, so as to leave a Cu-Zn-Al alloy mass.

Figure 24:
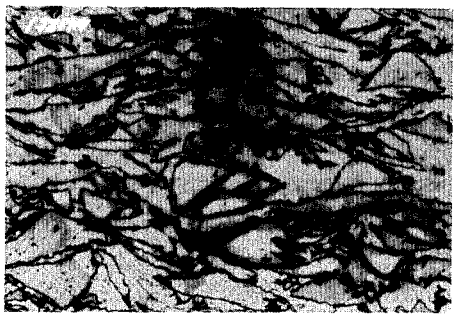
FIG. 24 is an optical microphotograph, similar to FIGS. 2, 7, 9, 11, and 13 through 23, of a section of a Cu-Zn-Al alloy mass produced according to a twenty-second preferred embodiment of the method of the present invention, enlarged at 100X magnification.

This Cu-Zn-Al alloy mass was then examined. Its macro-composition by weight was found to be approximately 34.0% Cu, 22.6% Zn, and 43.4% Al. FIG. 24 is an optical photomicrograph of a central section thereof, enlarged at 100X magnification. From FIG. 24, it will be seen that according to this twenty-second preferred embodiment of the present invention it is possible to produce Cu-Zn-Al alloy which has uniform and relatively fine composition; however it was also recognized that in this case, in which the first metal (the Cu-Zn alloy) was supplied in discontinuous fiber form, the composition and texture of the produced alloy were a little bit rough, as compared to the previously described cases in which the first metal was supplied in powder form. Further, this Cu-Zn-Al alloy mass was examined by EPMA. From this examination, it was found that the alloy was composed of nuclei of substantially pure $Cu_3Zn_2Al_8$, layers of CuZn+about 5.2 atomic % of Al surrounding these nuclei, and other layers of $Cu_3Al_{10}$+about 2.7 weight % of Zn surrounding these layers; and portions consisting substantially only of aluminum were not to be found. Thus it was verified that the diffusion process had well and sufficiently alloyed the copper and zinc alloy and the aluminum to form a fine structured Cu-Zn-Al alloy mass. The preheating of the porous copper and zinc alloy rectangular parallelepiped to a temperature substantially higher than the melting point of the aluminum to be alloyed therewith is again considered to have been particularly helpful in aiding with the diffusion of the molten aluminum and the copper and zinc alloy into one another to form a well mixed alloy.

When this Cu-Zn-Al alloy mass was appropriately tested, it was found to have superior corrosion resistance and strength.

THE TWENTY-THIRD PREFERRED EMBODIMENT

A high pressure casting apparatus substantially the same as that utilized in the first preferred embodiment of the method of the present invention described above and illustrated in FIG. 1 was used for practicing this twenty-third preferred embodiment, in which stainless steel iron alloy of JIS standard SUS-304 (with a melting point of 1480° C.) was chosen as the first metal to be alloyed, and aluminum alloy of JIS standard AC4C (with a melting point of about 580° C.) was chosen as the second metal to be alloyed. Thus, an Fe-Al alloy containing also other elements was manufactured, in a generally similar fashion to that employed for the practice of the first preferred embodiment described above, in the following way.

First, a porous or interstice-ridden rectangular parallelepiped of dimensions about 30 mm×10 mm×10 mm was made from the first metal to be alloyed, i.e. stainless steel iron alloy of JIS standard SUS-304, by laminating together a large number of thin foil sheets of such stainless steel, each of mean thickness 50 microns and of dimensions 30 mm×10 mm, so that the weight of the rectangular parallelepiped was about 11.82 gm and its bulk density was approximately 3.94 gm/cm$^3$. Then this laminated iron alloy rectangular parallelepiped was preheated to a temperature of approximately 800° C., and was then placed in the mold cavity of the casting mold. Then a quantity of substantially pure molten aluminum alloy at a temperature of about 750° C. was poured into the mold cavity over and around the porous iron alloy rectangular parallelepiped. Next, a pressure plunger was used, as in the practice of the first preferred embodiment, to pressurize the molten aluminum alloy, so as to infiltrate said molten aluminum alloy into the interstices of the iron alloy rectangular parallelepiped in order to form an Fe-Al alloy mass by diffusion of the two metals into one another; and this pressure was maintained until the composite mass had cooled down and completely solidified. Then, as before, the composite mass was removed from the apparatus, and the portions thereof consisting substantially only of the original aluminum alloy were machined away, so as to leave an Fe-Al alloy mass.

This Fe-Al alloy mass was then examined. Its macrocomposition by weight was found to be approximately 55.13% Fe, 25.5% Al, 13.41% Cr, and 5.96% Ni. No particular photomicrograph relating to this twenty-third preferred embodiment is provided, but it was found that, similarly to the other preferred embodiments described above, according to this twenty-third preferred embodiment of the present invention it is possible to produce Fe-Al alloy which has reasonably fine composition. However, it was recognized that in this case, in which the first metal (the stainless steel Fe alloy) was supplied in laminated sheet or foil form, the composition and texture of the produced alloy were comparatively rough, as compared to the previously described cases in which the first metal was supplied in powder form. But it is considered that the supplying of the first metal in such non-isotropic laminated form can be very helpful for giving non-isotropic physical properties to the resulting alloy, which in certain applications can be extremely useful.

Further, this Fe-Al alloy mass was examined by EPMA. From this examination, it was found that the alloy was composed of layers of laminated Fe alloy consisting substantially of Fe-18Cr-8Ni, with layers of $Fe_3Al$ on either side of these layers, and other layers of $Fe_2Al_3$ surrounding these layers of $Fe_3Al$; and portions consisting substantially only of aluminum alloy were not to be found. Thus it was verified that the diffusion process had well and sufficiently alloyed the iron alloy and the aluminum alloy to form a fine structured Fe-Al alloy mass. The preheating of the porous iron alloy rectangular parallelepiped to a temperature substantially higher than the melting point of the aluminum alloy to be alloyed therewith is again considered to have been particularly helpful in aiding with the diffusion of the molten aluminum alloy and the iron alloy into one another to form a well mixed alloy.

When this Fe-Al alloy mass was appropriately tested, it was found to have good heat resistance and good strength.

Although the present invention has been shown and described with reference to several preferred embodiments thereof, and in terms of the illustrative drawings, it should not be considered as limited thereby. Various possible modifications, omissions, and alterations could be conceived of by one skilled in the art to the form and the content of any particular embodiment, without departing from the scope of the present invention. For example, it is not considered that the preheating of the interstice-ridden body made of the first material is essential to the practice of the present invention, although it is preferred. Equally, it is not considered to be necessary to apply pressure to the molten second material, as it surrounds said interstice-ridden body, in order to make it enter into the interstices of said body, although again this is preferred. Therefore it is desired that the scope of the present invention, and of the protection sought to be granted by Letters Patent, should be defined not by any of the perhaps purely fortuitous details of the shown embodiments, or of the drawings, but solely by the scope of the appended claims, which follow.

What is claimed is:

1. A method for making an alloy of a first metallic material and a second metallic material which has a substantially lower melting point than the said first metallic material, comprising in the following specified order, the steps of:

(a) forming from particles of the said first metallic material having average particle size of less than 100 microns a solid body which has multiple fine interstices therein, the said solid body being heated at a temperature above the melting point of the said second metallic material;

(b) pouring the said second metallic material, in a molten state and heated above its melting point, around the said body formed from the said first metallic material so that the said body is directly submerged in a bath of the said molten metallic material; and, (c) pressurizing the said bath of the said molten metallic material and allowing the resultant mass to cool under the application of the pressure;

(d) wherein the said heating of the said second metallic material above its melting point is sufficient so that the heat supplied by the molten second metallic material is enough to alloy all of the said second metallic material which has entered into the said interstices of the said body with the said first metallic material forming the said body, whereby, in a part of the said resultant mass in which the said body formed from the said first metallic material was originally present, an alloyed mass comprising the first and the said second metallic alloyed together is made.

2. A method for making an alloy according to claim 1, wherein said first material from which the said body is formed has an average particle size of less than 50 microns.

3. A method for making an alloy according to claim 1, wherein said first material is titanium and said second material is aluminum.

4. A method for making an alloy according to claim 1, wherein said first material is silver and said second material is aluminum.

5. A method for making an alloy according to claim 1, wherein said first material is aluminum and said second material is lead.

6. A method for making an alloy according to claim 1, wherein said first material is silicon and said second material is copper.

7. A method for making an alloy according to claim 1, wherein said first material is cobalt and said second material is aluminum.

8. A method for making an alloy according to claim 1, wherein said first material is nickel and said second material is magnesium.

9. A method for making an alloy according to claim 1, wherein said first material is copper and said second material is tin.

10. A method for making an alloy according to claim 1, wherein said first material is tantalum and said second material is aluminum.

11. A method for making an alloy according to claim 1, wherein said first material is iron and said second material is aluminum.

12. A method for making an alloy according to claim 1, wherein said first material is niobium and said second material is aluminum.

13. A method for making an alloy according to claim 1, wherein said first material is vanadium and said second material is aluminum.

14. A method for making an alloy according to claim 1, wherein said first material is aluminum and said second material is tin.

15. A method for making an alloy according to claim 1, wherein said first material is zinc and said second material is tin.

16. A method for making an alloy according to claim 1, wherein said first material is tungsten and said second material is aluminum.

17. A method for making an alloy according to claim 1, wherein said first material is molybdenum and said second material is zinc.

18. A method for making an alloy according to claim 1, wherein said first material is gold and said second material is magnesium.

19. A method for making an alloy according to claim 1, wherein said first material is zirconium and said second material is aluminum.

20. A method for making an alloy according to claim 1, wherein said first material is manganese and said second material is aluminum alloy.

21. A method for making an alloy according to claim 20, wherein said aluminum alloy is substantially of JIS standard AC4C.

22. A method for making an alloy according to claim 1, wherein said first material is chromium and said second material is aluminum alloy.

23. A method for making an alloy according to claim 22, wherein said aluminum alloy is substantially of JIS standard AC4C.

24. A method for making an alloy according to claim 1, wherein said first material is silicon and said second material is magnesium alloy.

25. A method for making an alloy according to claim 24, wherein said magnesium alloy is substantially of ASTM standard AZ91C.

26. A method for making an alloy according to claim 1, wherein said first material is nickel and said second material is zinc alloy.

27. A method for making an alloy according to claim 26, wherein said zinc alloy is substantially of JIS standard ZDC1.

28. A method for making an alloy according to claim 1, wherein said first material is copper-zinc alloy and said second material is aluminum.

29. A method for making an alloy according to claim 28, wherein said copper-zinc alloy is composed substantially of about 60% copper and about 40% zinc.

30. A method for making an alloy according to claim 1, wherein said first material is iron alloy and said second material is aluminum alloy.

31. A method for making an alloy according to claim 30, wherein said iron alloy is substantially of JIS standard SUS-304.

32. A method for making an alloy according to claim 30, wherein said aluminum alloy is substantially of JIS standard AC4C.

33. The method of claim 1, wherein the degree of heating of the second metallic material is on the order of 20% of the melting point expressed in degrees centigrade.

* * * * *